US012359895B2

(12) United States Patent
Todd et al.

(10) Patent No.: US 12,359,895 B2
(45) Date of Patent: Jul. 15, 2025

(54) COMPACT HANDGUN PROTECTION BALLISTIC SHIELD

(71) Applicant: Verco Materials, LLC, Atlanta, GA (US)

(72) Inventors: Gabriel Todd, Atlanta, GA (US); Robert F. Speyer, Atlanta, GA (US); John A. Shupe, Atlanta, GA (US); Christian B. Schneider, Atlanta, GA (US)

(73) Assignee: Verco Materials, LLC, Atlanta, GA (US)

( * ) Notice: Subject to any disclaimer, the term of this patent is extended or adjusted under 35 U.S.C. 154(b) by 0 days.

(21) Appl. No.: 18/761,638

(22) Filed: Jul. 2, 2024

(65) Prior Publication Data

US 2025/0164217 A1 May 22, 2025

Related U.S. Application Data

(60) Provisional application No. 63/615,505, filed on Dec. 28, 2023, provisional application No. 63/542,381, filed on Oct. 4, 2023.

(51) Int. Cl.
*F41H 5/08* (2006.01)

(52) U.S. Cl.
CPC ..... *F41H 5/08* (2013.01)

(58) Field of Classification Search
CPC . F41H 5/08; F41H 5/04; F41H 5/0471; F41H 5/0478; F41H 5/0485
See application file for complete search history.

(56) References Cited

U.S. PATENT DOCUMENTS

| | | | |
|---|---|---|---|
| 6,370,690 | B1 | 4/2002 | Neal |
| 7,389,718 | B1 | 6/2008 | Carter et al. |
| 7,980,166 | B1 | 7/2011 | Fuqua et al. |
| 8,210,088 | B1 | 7/2012 | Keyfauver |
| 8,695,112 | B2 | 4/2014 | Bhatnagar et al. |
| 10,684,101 | B2 | 6/2020 | Zhang et al. |
| 11,035,650 | B2 | 6/2021 | De Lombaerde |
| 11,313,651 | B2 | 4/2022 | Hadtke et al. |
| 2002/0104429 | A1 | 8/2002 | Euler |

(Continued)

FOREIGN PATENT DOCUMENTS

| | | | |
|---|---|---|---|
| AU | 2017204889 | A1 | 2/2018 |
| JP | H07-305999 | A | 11/1995 |

(Continued)

OTHER PUBLICATIONS

Notification of Transmittal of the International Search Report and the Written Opinion of the International Searching Authority, date Mar. 5, 2024 in International Application No. PCT/US2023/030833.

*Primary Examiner* — J. Woodrow Eldred
(74) *Attorney, Agent, or Firm* — OSTROLENK FABER LLP

(57) ABSTRACT

A rollable ballistic shield that has a carrier having a strike face and a rear face opposite the strike face, a flexible ballistic panel inside the carrier facing the rear face, the flexible ballistic panel being comprised of a plurality of sheets ballistic fabric; and a resilient panel inside the carrier and facing the strike face, the resilient panel being a body that is rollable but returns to its unrolled shape when permitted to unroll.

29 Claims, 26 Drawing Sheets

(56) References Cited

U.S. PATENT DOCUMENTS

| | | | | |
|---|---|---|---|---|
| 2011/0314998 | A1 | 12/2011 | Engelbart | |
| 2012/0174748 | A1 | 7/2012 | Landi | |
| 2012/0177869 | A1 | 7/2012 | Micarelli | |
| 2012/0192339 | A1 | 8/2012 | Bhatnagar et al. | |
| 2015/0323292 | A1 | 11/2015 | Strauss | |
| 2015/0343737 | A1 | 12/2015 | Strauss | |
| 2015/0343738 | A1 | 12/2015 | Strauss | |
| 2016/0231088 | A1 | 8/2016 | Blackmore et al. | |
| 2018/0156577 | A1 | 6/2018 | Navin et al. | |
| 2018/0372452 | A1 | 12/2018 | MacNeil et al. | |
| 2019/0093990 | A1* | 3/2019 | Zhang | B32B 27/12 |
| 2020/0393217 | A1 | 12/2020 | Adrain | |
| 2021/0215459 | A1 | 7/2021 | Chen | |
| 2021/0254934 | A1 | 8/2021 | Hadtke et al. | |
| 2021/0396495 | A1 | 12/2021 | Ciparro et al. | |
| 2023/0160667 | A1 | 5/2023 | Adrain et al. | |
| 2023/0160668 | A1 | 5/2023 | Groat et al. | |
| 2023/0417513 | A1* | 12/2023 | Boydd | F41H 5/08 |
| 2024/0426581 | A1* | 12/2024 | Speyer | F41H 5/0435 |

FOREIGN PATENT DOCUMENTS

| | | | |
|---|---|---|---|
| KR | 10-1961686 | B1 | 3/2019 |
| WO | WO 2022/084758 | A2 | 4/2022 |
| WO | WO 2022/189963 | A1 | 9/2022 |
| WO | WO 2022/212726 | A1 | 10/2022 |

* cited by examiner

NATIONAL TECHNICAL SYSTEMS
BALLISTIC RESISTANCE TEST

Date Received: August 24, 2023
Via: UPS
Returned Via: UPS

Record No.: VRM23009.2
Test Date: August 25, 2023
Customer: Verco Materials LLC

Test Conditions

Temperature: 71 °F
Humidity: 53
Test Standard: Modified / Abbreviated NIJ 0108.01, September 1985
Classification: Type IIIA (.44 Magnum: Submachine Gun 9mm)
Threat Level: IIIA
Shots Required: 10 (5-Shots per Threat)
Conditioning: Ambient (Dry)

Range 3

Muzzle to Screen 1: 5.70 ft.
Screen 1 - 2: 5.00 ft.
Screen 2 - Target: 5.70 ft.
Midpoint to Target: 8.20 ft.
Target to Witness: 0.50 ft.
Witness Material: 2024-T3 Alum.
Barrel Length: 14 in.

| Sample Tested Description | | Shot / Ammunition Description | | | | | Chronograph | | Test Results |
|---|---|---|---|---|---|---|---|---|---|
| Manufacturer: | Verco Materials LLC | Shot No. | Shot Location | Degree Obliquity | Caliber | Bullet WOW (BO IN. | TIME ax-S | VELOCITY Ws | Penetration No Penetration |
| Model No.: | RC0821.2 | 1 | Top Left | | | | 351.9 | 1421 | No Penetration |
| Size (in.): | 20 x 18 | 2 | Top Right | | | | 346.7 | 1442 | No Penetration |
| Serial No.: | N/A | 3 | Bottom Right | 0° | .44 Mag. | 240 / LSWCGC | 356.8 | 1401 | No Penetration |
| Lot No.: | N/A | 4 | Bottom Left | | | | 349.0 | 1433 | No Penetration |
| Thickness (in.): | 0.245 | 5 | Center | | | | 349.2 | 1432 | No Penetration |
| Weight (lbs.): | 2.482 | 6 | Top Center | | | | 348.7 | 1434 | No Penetration |
| | | 7 | Right Center | | | | 353.7 | 1414 | No Penetration |
| | | 8 | Bottom Center | 0° | 9mm | 124 / FMJ | 355.9 | 1405 | No Penetration |
| | | 9 | Left Center | | | | 354.1 | 1412 | No Penetration |
| | | 10 | Center | | | | 352.2 | 1420 | No Penetration |

This test was performed in accordance with the specification requirements and the results properly reflect the ballistic performance of the listed sample.

National Technical Systems, Inc.
7447 W. 33rd St. N.
Wichita, KS 67205 U.S.A.
Phone 316.832.1600

Notes:

- Sample secured using airhydraulic frame and clamps.

Ammunition Description:

.44 Magnum 240 gr. (15.55g) Lead Semi-Wadcutter Gas Checked (LSWCGC).
Test Velocity: 1400 +/- 50 Ws 9mm, 124 gr. (8.0g) Full Metal Jacket (FMJ).
Test Velocity: 1400 H-50 Nis Shot Locations / Spacing:

- Minimum Requirement: 2.0" shot-to-edge and shot-to-shot spacing IAW Paragraph 3.2 Fair Hit.

Sample Description:

- Customer Proprietary.

Tech(s): Zerger / Nguyen

Figure 5

COMPACT HANDGUN PROTECTION BALLISTIC SHIELD

CROSS-REFERENCE TO RELATED APPLICATIONS

The present application claims priority to U.S. Patent Application Serial Nos. 63/542,381, filed Oct. 4, 2023, and 63/615,505, filed Dec. 28, 2023, the contents of which are incorporated by this reference.

FIELD OF INVENTION

The present invention is concerned with a ballistic shield that can be rolled and unrolled.

BACKGROUND OF THE INVENTION

Police officers face threatening conditions under a variety of circumstances: during SWAT operations, while serving warrants, or often even in routine traffic stops. Torso body armor to protect against handgun threats are standard issue. Body armor to protect against rifle threats is significantly heavier and can be fatiguing to wear all day. In either case, the armor typically provides protection to a portion of the torso; the face, extremities, and lower body are left unprotected.

There has been an increasing trend in law enforcement toward the use of ballistic shields, either rated to protect against handgun threats, or at a heavier weight and cost, to protect against rifle threats. Such shields, depending on their size, provide a much broader spectrum of ballistic protection, typically from the top of the head to mid-thigh when the holder is standing straight.

Such shields are typically, but not always, made of rigid materials, so that the shield may be set down on its edge without deforming, while the operator crouches down behind it. In a patrol car, such shields can, at best, be stored in the trunk of the vehicle, requiring time the officer may not have to retrieve it. Such a shield can also make it difficult for an officer to advance in constrained spaces such as narrow hallways or down the aisles of a school bus.

A minority of handgun shields which are presently used can be rolled or folded up into a smaller size. They are typically in the form of soft ballistic blankets or constructed of folded-up ballistic panels that gravity-deploy. Both suffer from the disadvantage of not being able to stand under their own weight without the time-consuming effort of installing stiffening rods, post-deployment. The panel systems also potentially suffer from focused points of fatigue and/or diminished ballistic effectiveness at the lines of convergence between the panels. Alternatively, they sustain added weight and diminished compactness when constructed of overlapping panels. Their gravity-induced deployment also occurs relatively slowly. A system involving the rapid release of gas (e.g. via $CO_2$ canister) into vertically-oriented bladders can potentially increase the speed of deployment, but is vulnerable to malfunction, or perforation of the gas bladder, either through rough handling or a ballistic event. By comparison, the great advantage of the present invention (disclosed below) is in its simplicity and reliability of operation.

In U.S. patent application Ser. No. 18/236,644, filed Aug. 22, 2023 (incorporated by this reference), the inventors disclose a compact rifle protection ballistic shield that can be rolled for storage and unrolled to serve as a shield.

Since the development of that compact rifle protection ballistic shield, the inventors have identified a need for a lighter-weight handgun shield, which similarly rolls up for storage, and then unrolls to serve as a shield.

SUMMARY OF THE INVENTION

It is an object of the present invention to provide a compact handgun protection ballistic shield that can be rolled for storage and unrolled to serve as a shield.

Disclosed herein is a handgun shield that rolls up into a small space, deploys in less than one second with a single-hand release, becomes semi-rigid when deployed, stops all of the handgun threats typically encountered, and is very lightweight. In conjunction with a connected sling, the handgun shield can be worn over the shoulder and appear to be a gym bag. In that form, the handgun shield can be carried at, for example, large public gatherings, without the threatening appearance of a hard shield. The cavity inside the rolled up shield can house, for example, medical supplies or a breaching toolkit. The handgun shield can also reside on the floor of the passenger seat of a patrol car for immediate access. The handgun shield is adequately stiff to maintain its shape with rapid movement and hold up under its own weight, yet is compliant when advancing through a path with obstacles.

A rollable ballistic shield according to the present invention includes a flexible ballistic panel, the flexible ballistic panel being comprised of a plurality of sheets of ballistic fabric; and a resilient panel, the resilient panel being a body that is rollable but, with a spring force, returns to its unrolled shape when permitted to unroll.

The resilient panel may be curved along its longitudinal axis, and may have a radius of curvature in the range 4 to 6 inches.

The plurality of sheets of ballistic fabric in the flexible ballistic panel may be stitched together, and may be sheets of ultra-high molecular weight polyethylene ballistic fabric, or sheets of aramid ballistic fabric. The resilient panel may be made of consolidated carbon fiber prepreg fabrics. The flexible ballistic panel may have a plurality of spaced flaps that wrap over edges of the resilient body, giving the edges more firmness against snapback during a near-edge ballistic impact and improving ballistic performance for shots near the edges while still allowing the shield to be rolled up without the flaps bunching up and restricting movement. The resilient panel may be made of at least two attached resilient bodies each being made of, for example, consolidated carbon fiber prepreg fabric sheets. The flexible ballistic panel and the resilient panel(s) may be slidable relative to one another to facilitate unrestricted rolling and unrolling.

The rollable ballistic shield may further include an elongated rib assembly having at least one elongated rib located at the flexible ballistic panel's rear face. The elongated rib assembly may have a plurality of elongated ribs connected to one another, each comprising a carbon fiber panel, and the resilient panel(s) and the rib assembly may be curved about their longitudinal axes.

The rollable ballistic shield may further include a carrier having a strike face and a rear face opposite the strike face, the flexible ballistic panel and the resilient panel residing in the carrier.

The rollable ballistic shield may further include an inner enclosure, the flexible ballistic panel and the resilient panel residing inside of the inner enclosure. The inner enclosure may be water-tight.

The rollable ballistic shield may further include another resilient panel in the carrier located between the flexible ballistic panel and the rear face of the carrier. The carrier may have a first pocket that receives a bottom portion of the another resilient panel, and a second pocket that receives a bottom portion of the resilient panel and a bottom portion of the flexible ballistic panel. The resilient panel and the another resilient panel may be both curved.

The carrier may have an upper section and a lower section, the upper section being narrower than the lower section, the shapes of the resilient panel and the flexible ballistic panel corresponding to the carrier's shape and are received in the carrier without play to keep the carrier in a taut state.

The carrier may have a transition section located between the upper section and the lower section, the transition section is as wide as the upper section along one edge thereof, and as wide as the lower section along an opposite edge thereof. The upper section may be no more than 33% of the carrier's length and the lower section may be at least 60% of the carrier's length.

The carrier may further include a handle and an actuator located close enough to the handle to permit an operator to, with a single hand, hold the shield and reach the actuator while the shield is in the rolled state, wherein the actuator is movable, and wherein moving the actuator releases a fastener that keeps the shield in the rolled state, allowing the shield to rapidly unroll.

The rollable ballistic shield may further have a second resilient panel inside the carrier and glued to the carrier to push the flexible ballistic panel into the first resilient panel, whereby the first resilient panel, the flexible ballistic panel, and the second resilient panel are tightly held together inside the carrier making the shield responsive to the manipulation of the handle.

Other features and advantages of the present invention will become apparent from the following description of the invention which refers to the accompanying drawings.

BRIEF DESCRIPTION OF THE DRAWINGS

FIG. 5 is a reproduction of a report on a ballistic test of a panel constructed according to the present invention.

DETAILED DESCRIPTION OF EMBODIMENTS OF THE INVENTION

Figure 1A:
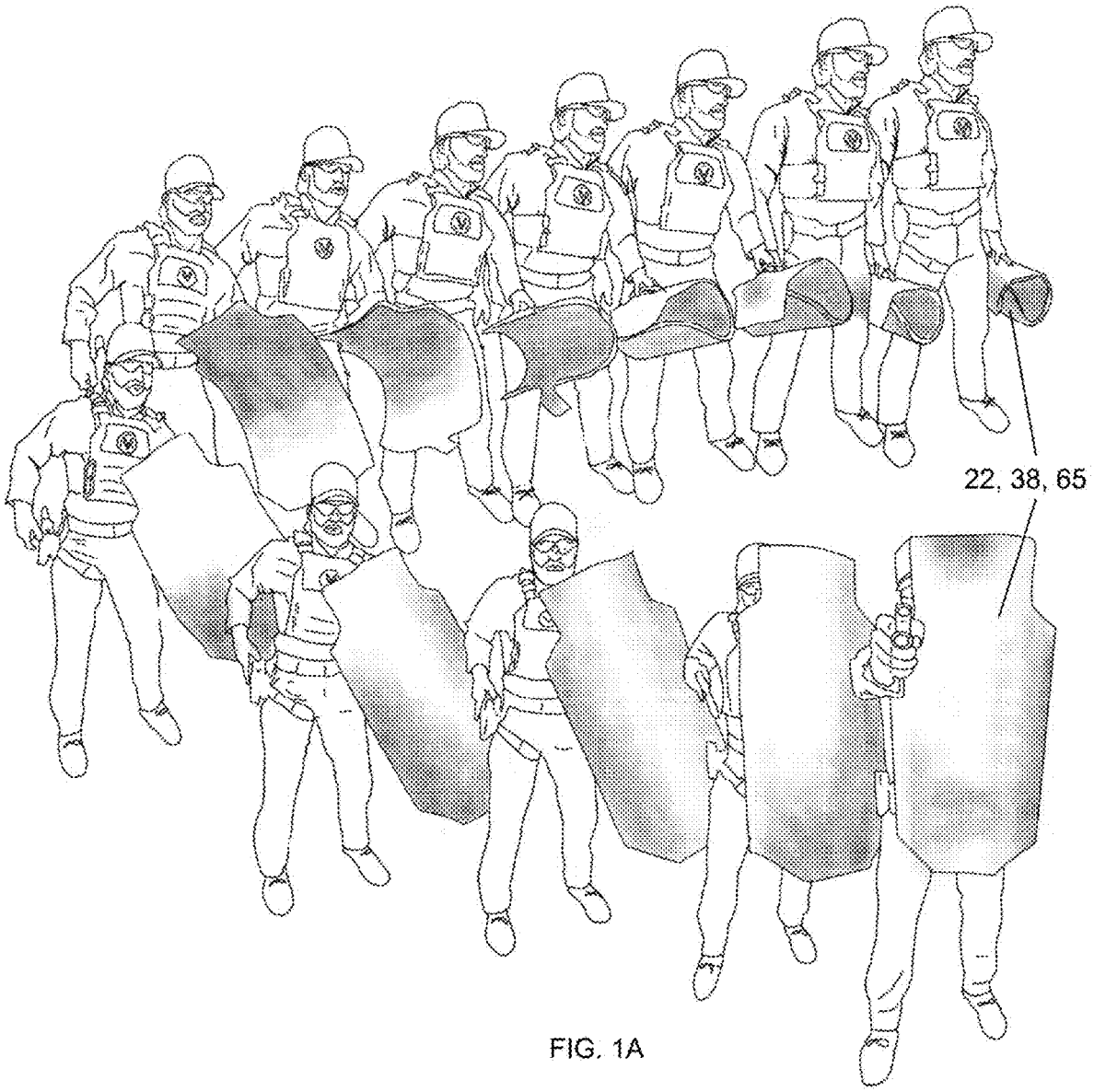
FIG. 1A shows a compact handgun protection ballistic shield ("shield") according to the present invention, being unrolled from a rolled state and positioned in front of the operator.
Figure 1B:
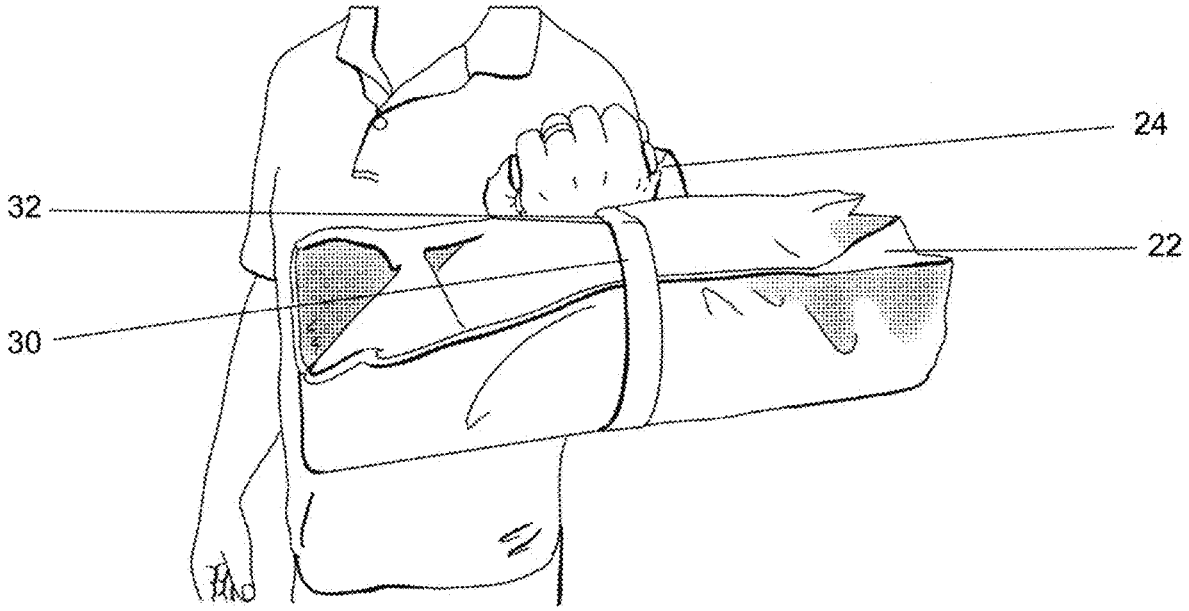
FIG. 1B shows the present invention in a rolled state.

Referring to FIG. 1A, a ballistic shield (22, 38, 65) according to the present invention can be transformed from a rolled state to an unrolled state and positioned to protect the operator from the top of the head to mid-thigh, for example, in less than one second. Referring to FIG. 1B, a shield 22 according to the present invention includes a handle 24 attached to the rear face of a carrier 10 (FIG. 1C) component thereof facing the operator when the shield 22 is deployed. A strap 30 that in the disclosed embodiment wraps around the shield 22 when the shield 22 is in the rolled state keeps the shield 22 in the rolled state. The strap 30 has one end attached (for example by stitching) to the rear face of the carrier 10 of the shield 22. Once the strap 30 is wrapped around the rolled shield 22 as seen in FIG. 1B, its free end may be secured to the rear face of the carrier 10 of the shield 22 using a hook and loop (e.g. Velcro®) fastener 32. Specifically, one component of the hook and loop fastener 32 may be attached to the free end of the strap 30 and the other component thereof attached to the rear face of the carrier of the shield 22. The strap 30 may be located between the lateral edges of the carrier 10 of the shield 22 at a central location equidistant from each lateral edge. The hook and loop fastener 32 may be located in front of the handle 32, which may be also positioned at a central location equidistant from each lateral edge.

The strap 30 need not wrap around the shield 22.

Instead of the strap 30, a thumb-latch trigger on the handle may be used to keep the shield 22 in the rolled state and to deploy the shield 22 with the same hand holding the handle 24.

Figure 1C:
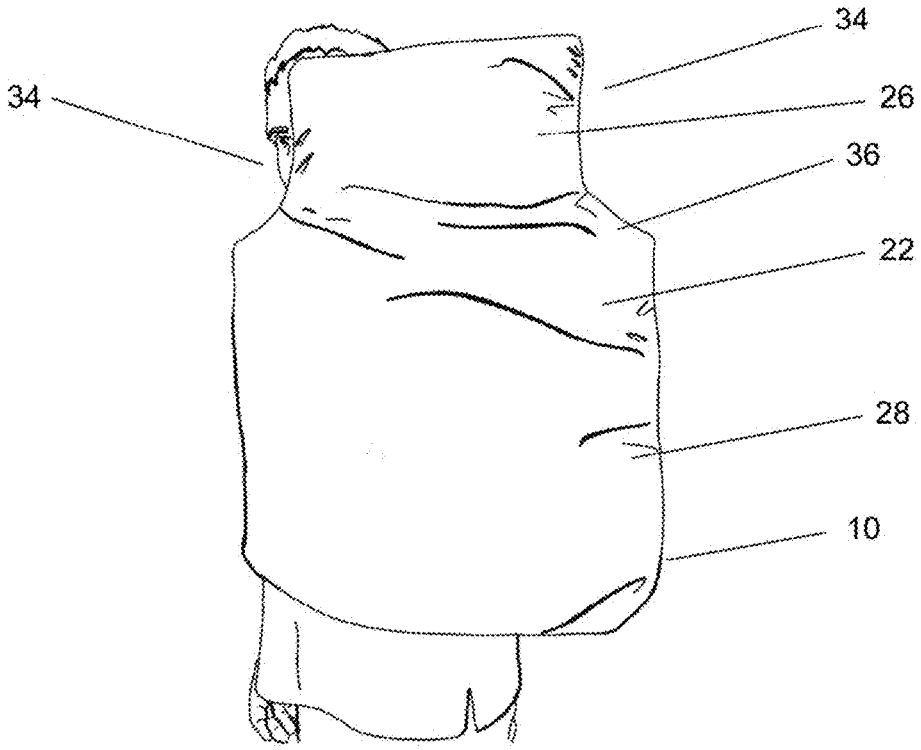
FIG. 1C shows the shield in an unrolled (deployed) state.

Once the strap 30 is released by uncoupling the hook and loop fastener 32, the shield 22 unrolls and becomes deployed as seen in FIG. 1C. Specifically, an operator may hold the handle 24 with one hand and uncouple the hook and loop fastener 32 with the other hand whereby the shield 22 deploys to provide protection to the operator as the operator stands behind the shield 22 facing the rear face thereof.

The carrier 10 of the shield 22 may include an upper section 26 and a lower section 28. The lower section 28 constitutes more than 60% of the length of the carrier 10 of the shield 22 and the upper section constitutes no more than 33% of the length of the carrier 10 of the shield 22. The upper section 26 is narrower than the lower section 28 to provide open areas 34 above the lower section 28 adjacent to the upper section 26. The operator may use the open areas 34 for visual surveillance and/or may use the open areas 34 for positioning a weapon.

In the embodiment shown, the carrier 10 of the shield 22 includes a transition section 36 located between the upper section 26 and the lower section 28. The top side of the transition section 36 is as wide as the bottom side of the upper section 26, the bottom side of the transition section 36 is as wide as the top side of the lower section 28, and the lateral edges of the transition section extend from the top side thereof to the bottom side thereof. Thus, the transition section 36 has a varying width like a trapezoid. The lateral edges of the transition section 36 define the lower sides of the open areas 34 above the lower section 28.

Figure 2:
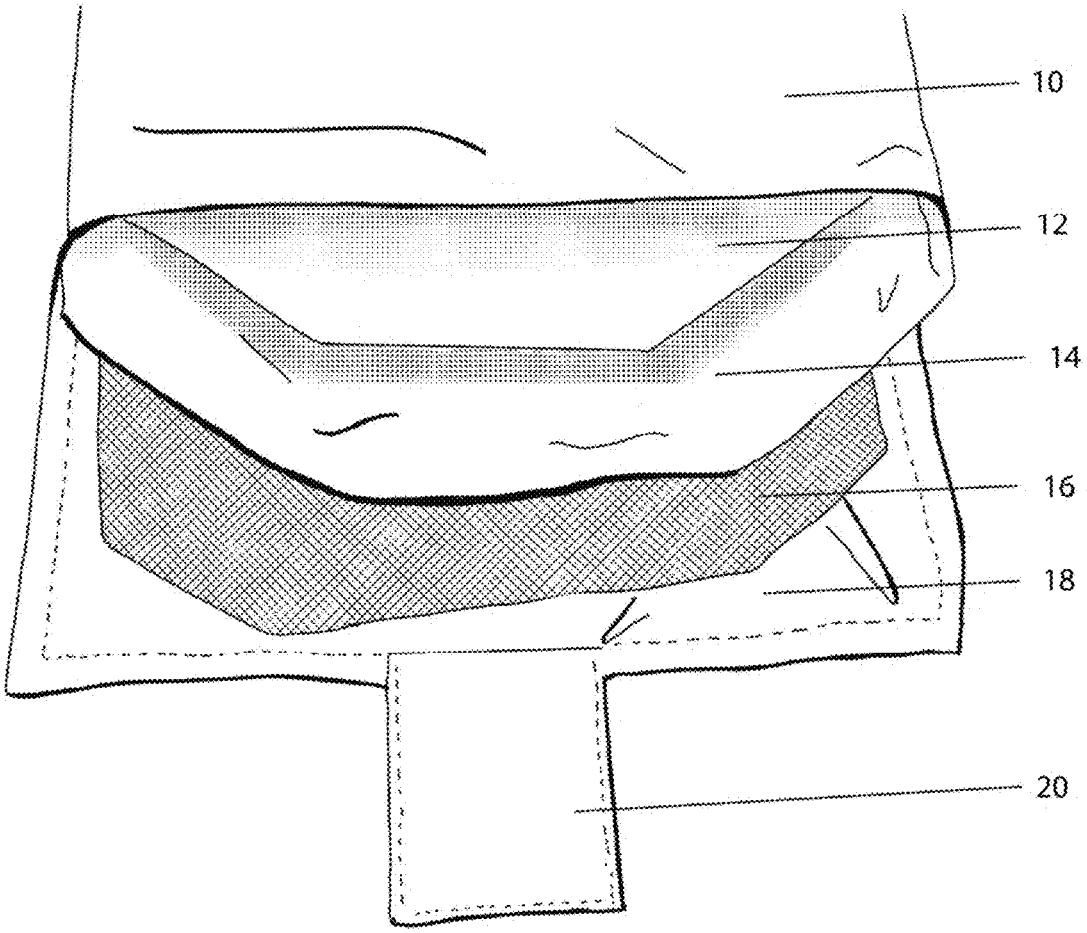
FIG. 2 shows the components of the first embodiment of the shield, partially-inserted into a carrier.

Referring to FIG. 2, a shield 22 according to the present invention includes the carrier 10 that contains therein components of the shield 22. The carrier 10 may be made of a suitable fabric and defines the shape of the shield 22 in its deployed state as seen in FIG. 1B, for example. The carrier 10 may be made of two fabric sheets that are attached to one another along the edges thereof to define a pocket in which the other components of the shield 22 are received. The pocket for receiving the other components of the shield 22 may be accessed, for example, from an opening at the bottom of the carrier 10, which can be closed by a flap 18.

The other components of the shield include a flexible ballistic panel 14, and a resilient panel 16. Optionally, a soft panel 12 of one or more thin sheets of foam may be included as a component.

The resilient panel 16 may be made of several sheets (for example, three or four) of carbon fiber prepreg fabric that are consolidated to form a unitary body. The carbon fiber prepreg sheets are consolidated by applying a suitable amount of heat and pressure in an autoclave to set the epoxy component of the pre-preg, for example. The main characteristic of the resilient panel 16 is that it can be rolled but returns to its original shape once it is permitted to unroll.

The flexible ballistic panel 14 is constructed with layers of soft ballistic fabric sheets (e.g. ultra-high molecular weight polyethylene, or aramid) that are attached to one another by stitching, for example. The sheets of soft ballistic fabric may be sewn together in sub-packs, for example, four sub-packs, each with perimeter tack stitches. The sub-packs may be then mutually attached as described in U.S. Ser. No. 18/236,644 so that the sub-packs may slide on each other during rolling and unrolling, without losing their mutual alignment when the shield 22 is deployed.

The resilient panel 16, and the flexible ballistic panel 14 have shapes that correspond to each other and correspond to the shape of the pocket of the carrier 10 and are sized so that they stretch the carrier 10 taut when received in the carrier's pocket. Consequently, the resilient panel 16 and the flexible ballistic panel 14 do not shift and play in the carrier's pocket when the shield 22 is deployed. Thus, the resilient panel 16 and the flexible ballistic panel 14 would each have an upper section corresponding in shape to the upper section 26 of the carrier 10 of the shield 22, a lower section corresponding in shape to the lower section 28, and a transition section corresponding in shape to the transition section 36. Preferably, once the shield 22 is in the deployed state the resilient panel 16 would cover as much of the flexible ballistic panel 14 as practicable. When present, the soft panel 12 would have a shape corresponding to the shape of the flexible ballistic panel 14 also.

Referring to FIG. 2, once inside the carrier 10, in the deployed state (FIG. 1B), the resilient panel 16 is closest to the strike face (the face oriented toward the incoming bullet) of the shield 22, facing away from the operator. The flexible ballistic panel 14 is closer to the rear face of the shield 22. The resilient panel 16 and the flexible ballistic panel 14 are detached from one another and can slide relative to one another. When present, the soft panel 12 is positioned closest to the rear face of the carrier 10 of the shield 22.

The carrier 10 may be opened at the bottom side of the lower section 28 to provide access to the carrier's pocket in which the other components are received. The flap 18 may then close the opening at the bottom side of the lower section 28. An elastomeric strip 20 is attached at one end thereof to the bottom edge of the flap 18. The Flap 18 closes the opening at the bottom side of the lower section 28 by wrapping around to the rear face of the flexible ballistic panel 14 (or rear face of the soft panel 12, if it is utilized), tucking into a position adjacent to the interior wear face side of the carrier 10. The elastomeric strip 20 may be detachably attached to the interior surface of the rear face fabric of the carrier 10 using, for example, a hook and loop fastener. Specifically, one component of the hook and loop fastener may be attached to the free end of the elastomeric strip 20, and the other component of the hook and loop fastener may be attached to the rear face of the carrier 10. The elastic nature of the elastomeric strip 20 allows for the rolling and unrolling of the shield 22 without detachment of the elastomeric strip 20 from the rear face of the carrier. Consequently, in the rolled state, the flap 18 will keep the opening at the bottom side of the lower section 28 closed, and the components inside the carrier 10 aligned in the rolled and the deployed (unrolled) states.

Figure 3:
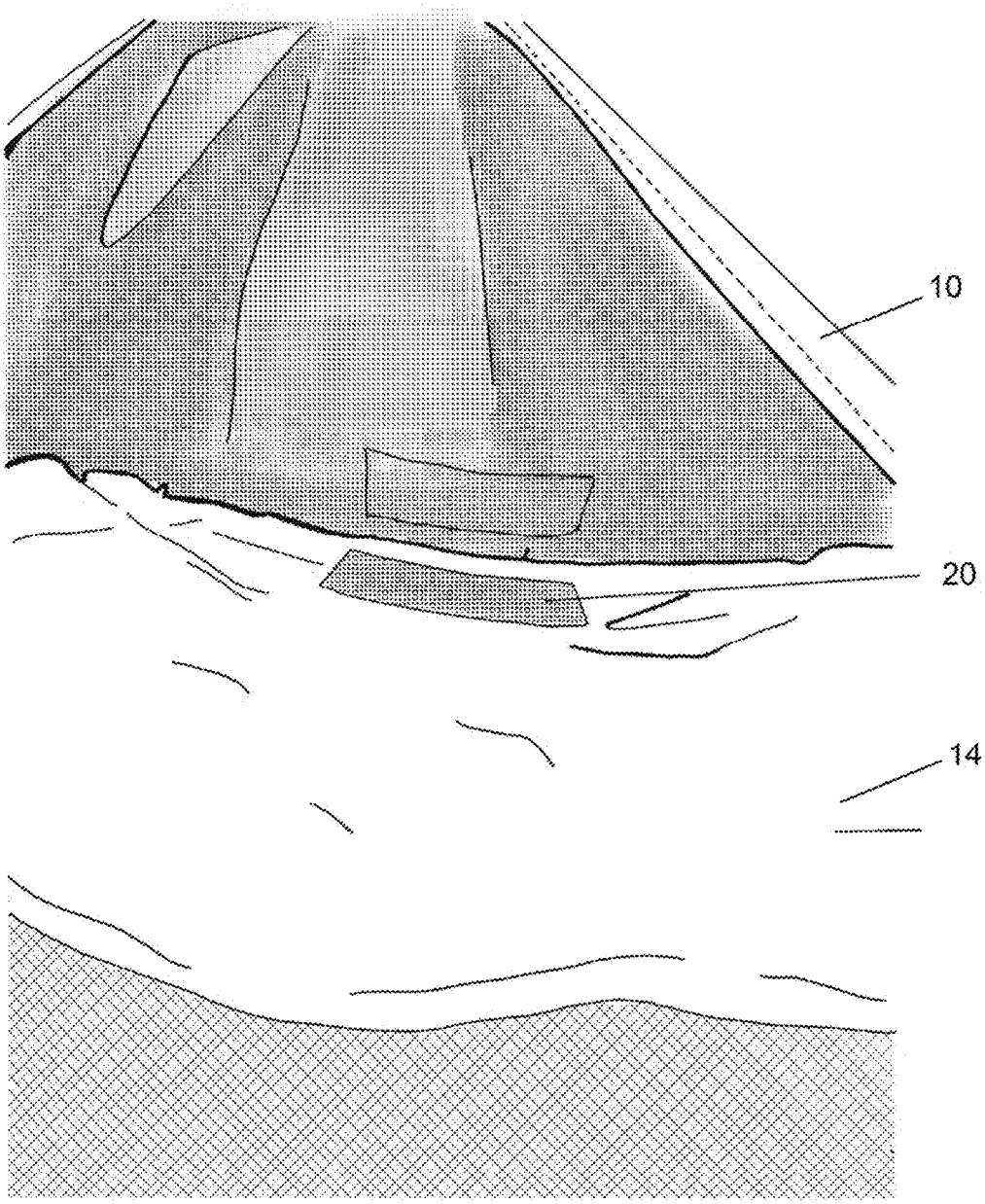
FIG. 3 shows the flexible ballistic panel component of the shield partially inserted in the carrier component of the shield, with the rear face fabric of the carrier lifted up.

Referring to FIG. 3, optionally the flexible ballistic panel 14 may be detachably attached to the interior of the rear side fabric of carrier 10 either directly or indirectly. That is, assuming soft panel 12 is not present, a hook and loop fastener 32 may be used to affix the flexible ballistic panel 14 to the interior surface of the rear face (face opposite the strike face) of the carrier 10 directly. If the soft panel 12 is present, the flexible ballistic panel 14 may be adhesively attached to the soft panel 12, and the soft panel 12 detachably attached to the interior of the carrier 10 by the hook and loop fastener 32.

Figure 4:
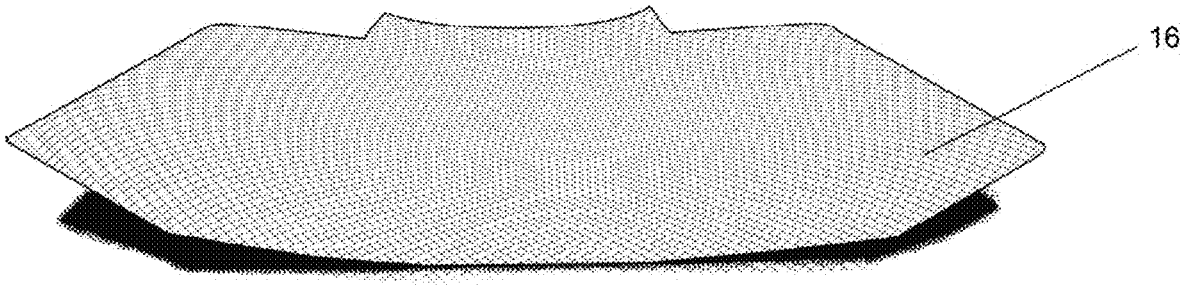
FIG. 4 shows the resilient panel component of the shield.

Referring now to FIG. 4, the resilient panel 16 in its unrolled state is slightly curved about its longitudinal axis (axis extending from its top side to its bottom side) in the deployed state. Due to the slight curve, the resilient panel 16 stores mechanical energy when the resilient panel 16 is rolled around the axis transverse to its longitudinal axis, much like a spring or a tape measure as, for example, shown in the 1864 patent by W. H. Bangs for a "spring" pocket tape measure. The resilient panel 16 flattens and loses its curvature when rolled into a tight radius of curvature (4 to 6 inches in diameter), and snaps back straight (in the vertical direction) when released, recovering the curvature. Thus, as the shield 22 is released from its rolled state following the detachment of strap 30, the resilient panel 16 of the shield 22 returns to its unloaded (curved) configuration, causing the shield to unroll automatically. That is, the resilient panel 16 acts as a spring mechanism that is loaded when the shield 22 is rolled and is unloaded when the strap 30 is detached to permit the shield 22 to unroll. The curvature of the resilient panel should be selected to permit rolling of the panel as described herein.

Shields of varying dimensions will require differing amounts of spring back force to properly deploy from their rolled state. The restoring force of the resilient panel 16 may be adjusted by adding or subtracting sheets of carbon fiber prepreg fabric and altering the radius of curvature.

Instead of or in addition to the resilient body made of consolidated carbon fiber prepreg fabrics, one could envision making the resilient panel 16 with different consolidated fiber fabric composites, e.g., fiberglass-alternatively, a sheet of metal or plastic.

As an example, a ballistic shield 22 was constructed using a carbon fiber resilient panel composed of four sheets of carbon fiber prepreg fabric autoclaved together. Set behind it (toward the rear face of the shield) was a flexible ballistic panel of thirty sheets of ultra-high molecular weight polyethylene sewn together with three evenly spaced, vertically oriented two-inch-long bar tacks along the two vertical edges. This panel was ballistically evaluated at a nationally certified ballistic testing laboratory (NTS Wichita). The test report is reproduced in FIG. 5. The panel stopped all five of the 0.44 Mag 240/LSWCGC bullets and all five of the 9 mm 124/FMJ bullets, all fired at muzzle velocity.

FIGS. 6-9 show the steps in the construction of a shield 38 according to the second embodiment of the present invention.

Figure 6:
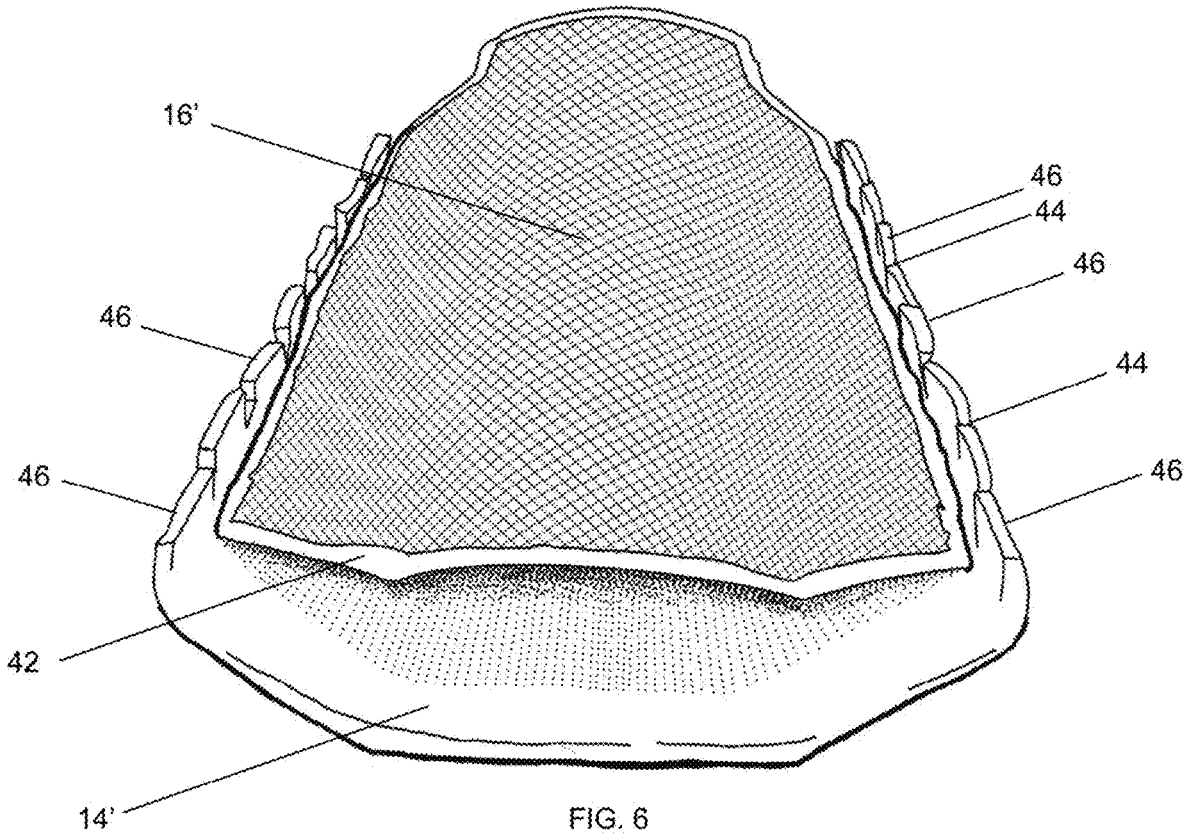
FIG. 6 shows components of a shield according to the second embodiment in a disassembled state.
Figure 7:
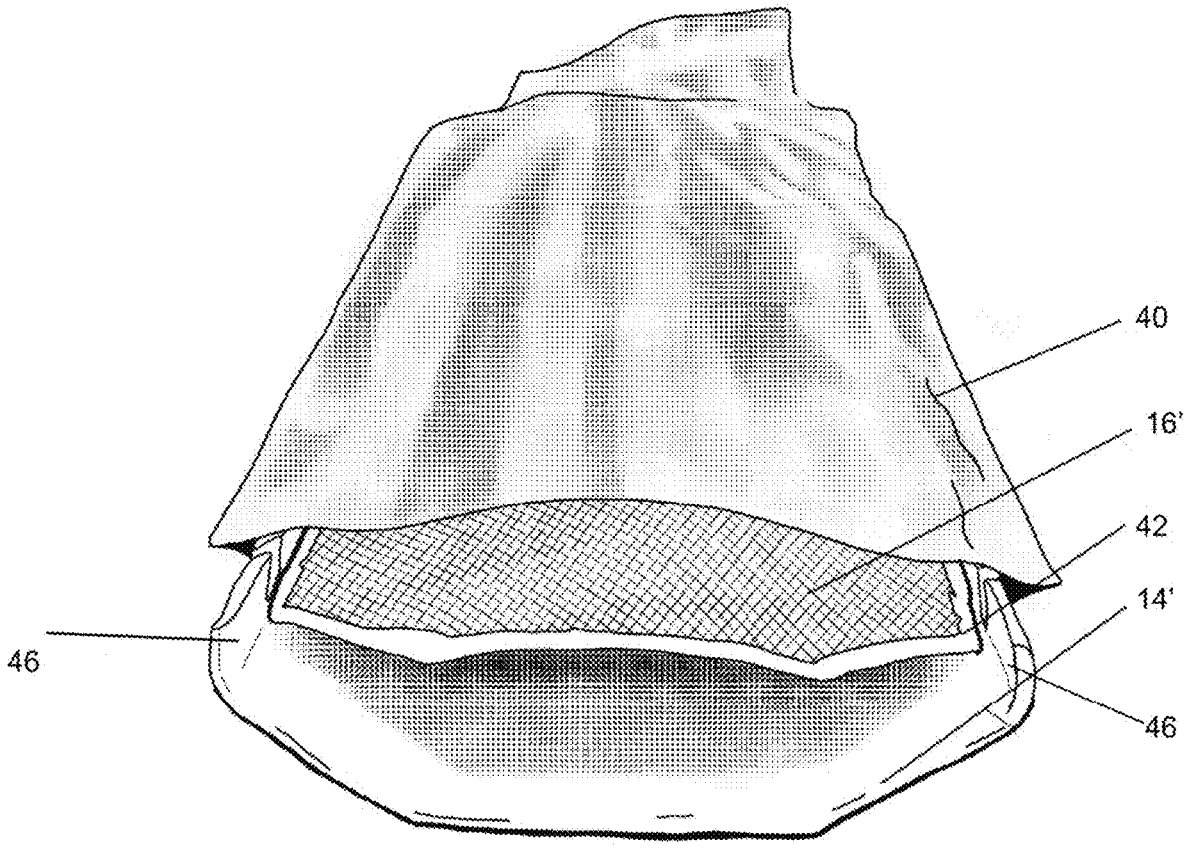
FIG. 7 shows the components seen in FIG. 6 partially inserted in an inner enclosure.

FIG. 6 shows the flexible ballistic panel 14' and the resilient panel 16', which will be received in an inner enclosure 40 (FIG. 7). The inner enclosure 40 is an environmental enclosure, which is preferably based on a sealable water-tight fabric.

The resilient panel 16' is composed of two sets of three autoclaved-together (consolidated) carbon fiber prepreg fabric sheets. The autoclaving applies elevated temperature and pressure to press the carbon fiber prepreg fabric sheets against a curved mold to adopt the curved shape seen in FIG. 6. While being autoclaved, the sheets are sealed in an evacuated bag. The two sets of cured carbon fiber prepreg fabric sheets are held together with strips of adhesive-coated aramid (Twaron) fabric 42 which wraps around the edges and onto the exterior faces of the two sets of cured carbon fiber prepreg fabric sheets. Behind the carbon fiber assembly (in the direction of the rear face of the armor) is the flexible ballistic panel 14', which may be constructed with thirty (30) sheets of ultra-high molecular weight polyethylene ballistic fabric. A serrated cutout 44 on the long two sides of the flexible ballistic panel 14' create periodic, spaced fabric flaps 46. The sheets of ultra-high molecular weight polyethylene ballistic fabric are sewn with two-inch-wide stitches running parallel to the long sides, four of them, evenly distributed per side. The stitches may be ¾" inset from the interior-most cuts between flaps. The thirty sheets of ultra-high molecular weight polyethylene ballistic fabric are flexible enough to roll, while effective in intercepting a ballistic from a handgun. While not shown, two sheets of thin foam may be inserted into the inner enclosure 40 on the rear face side of the flexible ballistic panel 14'.

Figure 8:
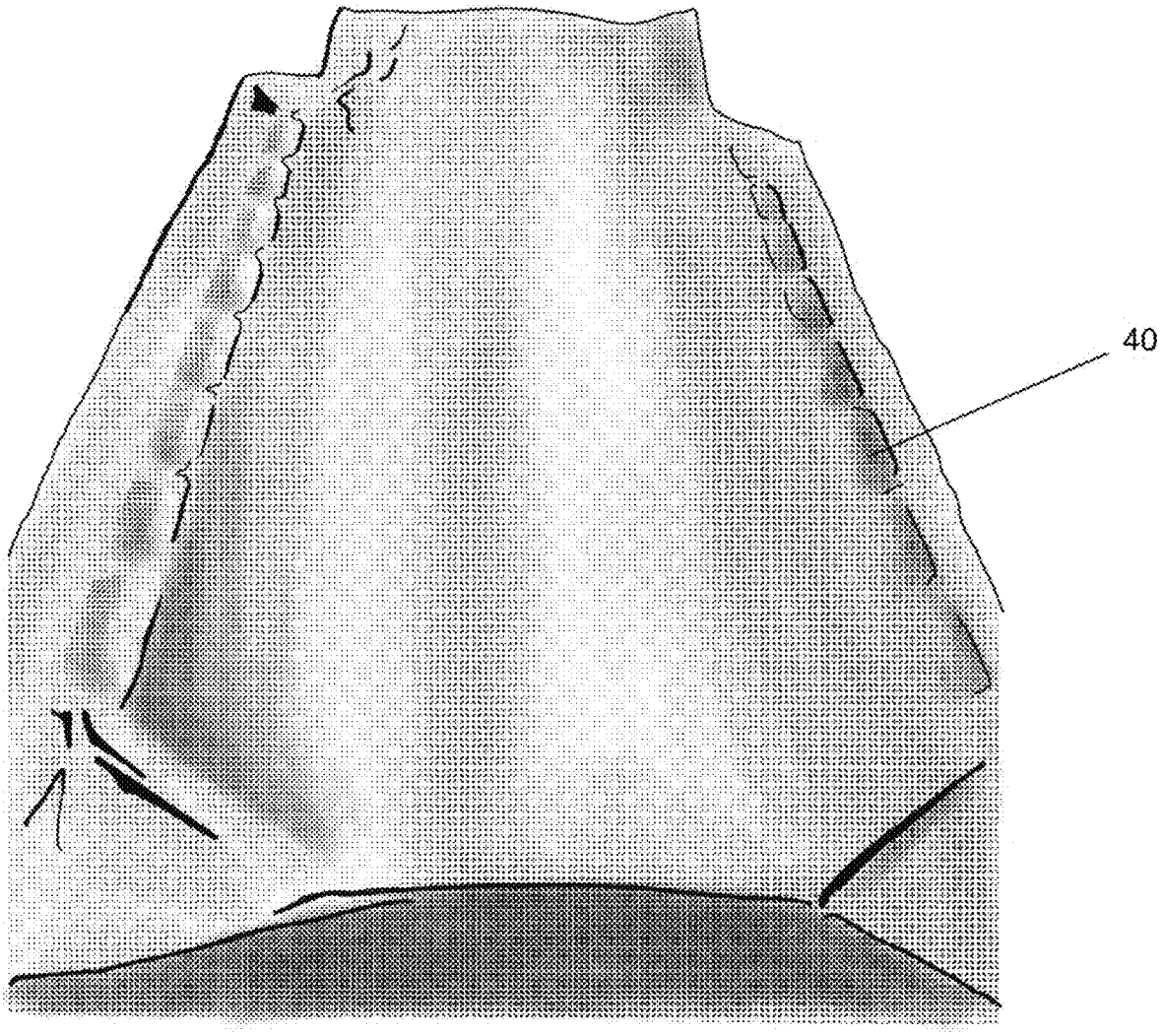
FIG. 8 shows the components seen in FIG. 6 fully received in the inner enclosure and sealed while under vacuum.

FIG. 7 shows the flexible ballistic panel 14' and the resilient panel 16' inserted into a TPU-laminated (thermoplastic polyurethane) nylon inner enclosure 40, with the foam sheets (not shown). The inner enclosure 40 is then sealed (ultrasonically or heat/pressure bar sealed) under vacuum so that as shown in FIG. 8, the flaps 46 are pressed down onto the strike face of the resilient panel 16' by atmospheric pressure. Air is once again allowed into the inner enclosure 40 and then re-sealed (forming a water-proof cover).

Figure 9:
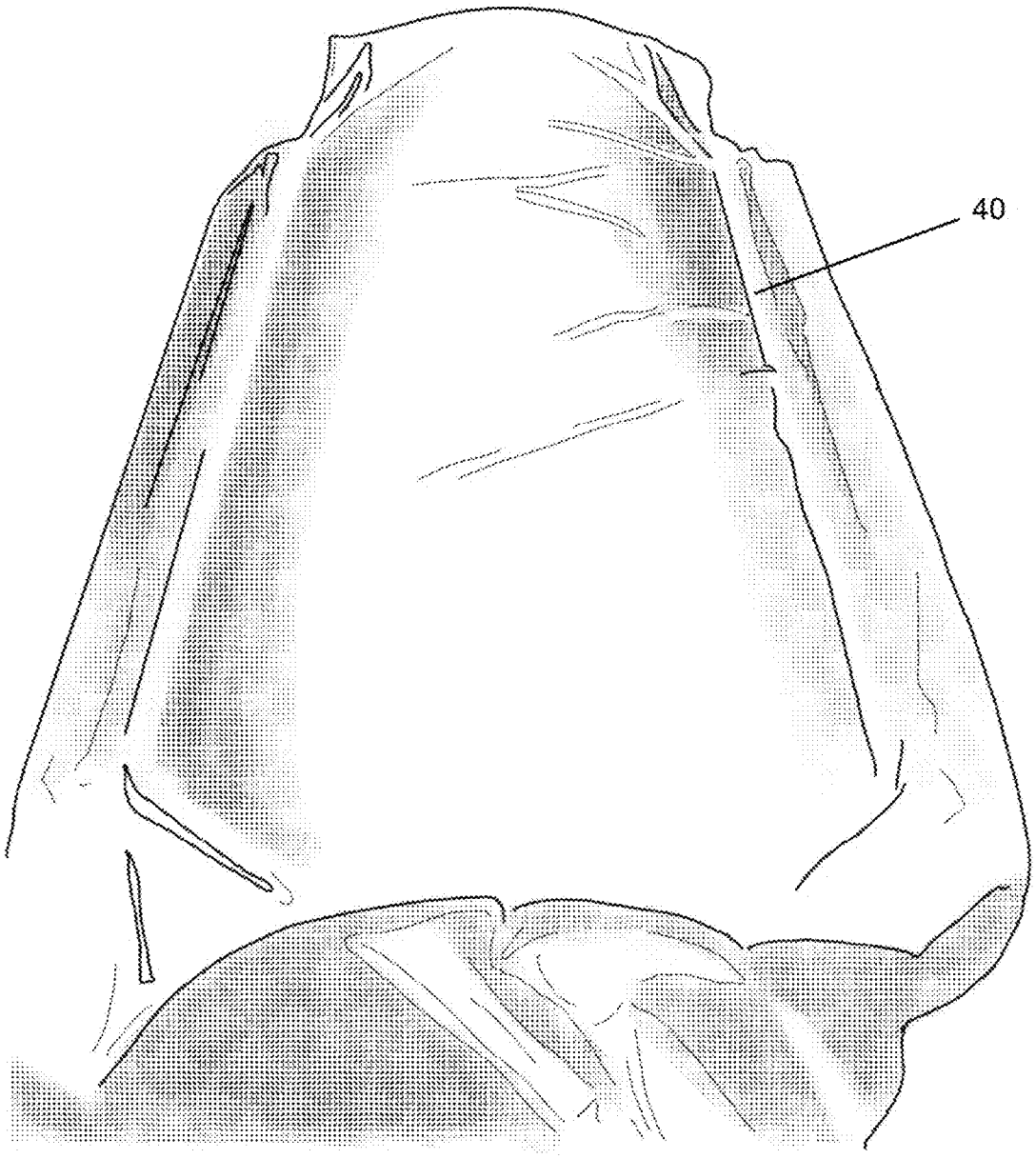
FIG. 9 shows the inner enclosure with slack all the way around.

Referring to FIG. 9, the inner enclosure 40 has slack all the way around and applies no squeeze to its contents. The fabric flaps 46 are now only partially wrapped around to the strike face of the resilient panel 16'. With this arrangement, the flexible ballistic panel 14' and the resilient panel 16' remain detached from one another and can easily slide relative to one another. The fabric flaps 46 help to maintain alignment between the resilient panel 16' and the flexible ballistic panel 14' over repeated rolling and unrolling cycles.

The wrap-around flaps 46 were developed to improve, and ballistically shown to improve, the stopping capability of bullet impacts close to the left and right edges of the shield. They also imbue stiffness to the near edge regions so that it attenuates snapback of the shield into the torso or the face of the holder from near-edge bullet impacts. The separation of the flaps allows space for the flaps to rotate toward each other during rolling. Single, continuous wrap-around flaps on the two sides would bunch up and inhibit rolling.

The assembly of the flexible ballistic panel 14' and the resilient panel 16' in the inner enclosure 40 is then inserted into a carrier 10 similar to the one used in the first embodiment described above and also described in U.S. patent application Ser. No. 18/236,644, which can expand and contract at its bottom during rolling and unrolling.

The flexible ballistic panel 14' is made up of individual sheets of ultra-high molecular weight polyethylene fibers. These sheets develop appreciable friction between the various layers. After being stored in the rolled up-state for an elongated period, the flexible ballistic panel can exert a significant resistance to the straightening influence of the single resilient panel 16. To further aid in reliable, rapid, and complete straightening of the panel during unrolling, a second embodiment was developed. For the second embodiment, a carbon fiber assembly of two sheets of carbon fiber prepreg fabric were autoclaved together to form a second carbon fiber assembly, i.e., a second resilient panel 16", shaped to have the same curve as the previously-described one inserted into the carrier 10 (or carrier 10' of the third embodiment, FIG. 14, discussed below). The second resilient panel 16" is located outside of the inner enclosure 40, positioned on its wear face side. The second resilient panel 16" has the same concavity orientation as the first resilient panel 16' in the inner enclosure 40. An adhesive lamination between the second resilient panel 16" and the interior of the wear face side of the carrier causes the two bodies to everywhere cohere. This gives a more tight connection between the rear face handle 24 and the entirety of the shield 38. The curvature of the second resilient panel 16" acts to push the flexible ballistic panel 14' into the resilient panel 16' in the inner enclosure 40 when the shield is in its unrolled state. These features allow the shield to move stiffly and responsively to slight movements and rotations of the rear face handle 24.

Figure 10:
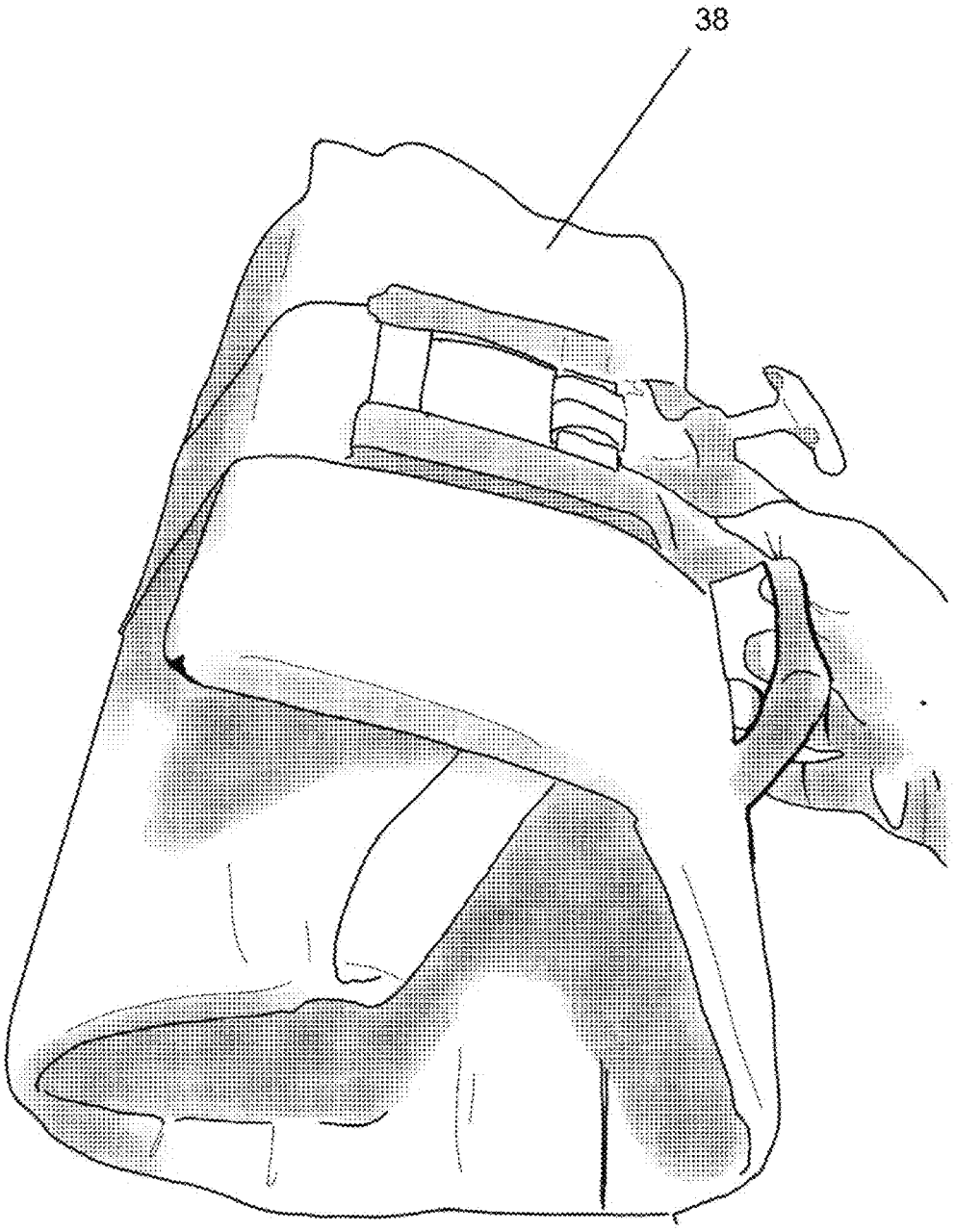
FIG. 10 shows the shield according to the second embodiment in a rolled (stored) state.

FIG. 10 shows the shield 38 according to the second embodiment in its rolled-up (stored) state. The shield 38 remains in its rolled state by hook and loop fasteners 60 (FIG. 12).

Figure 11:
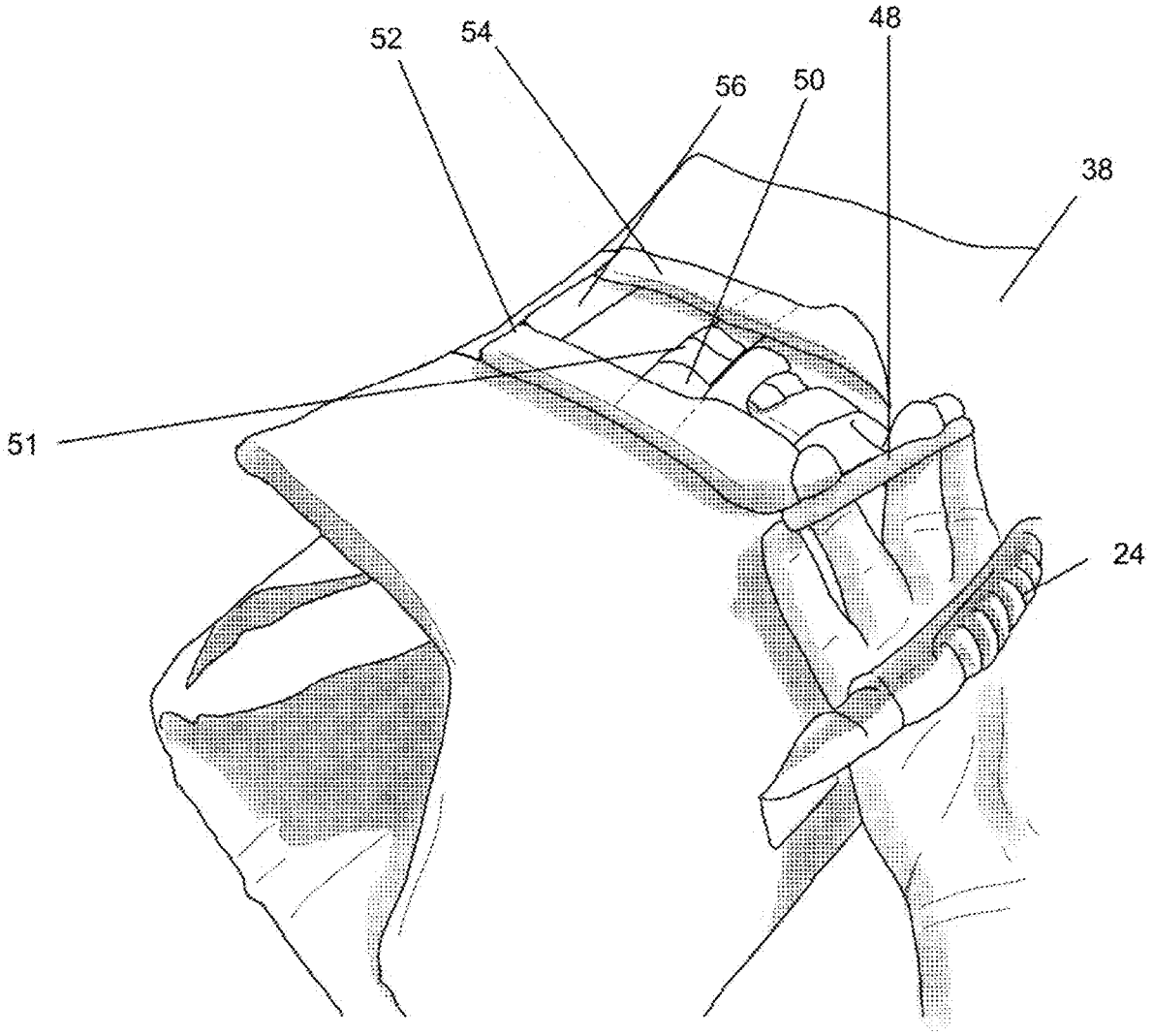
FIG. 11 shows the shield seen in FIG. 10 with a user's fingers in position to deploy the shield.
Figure 12:
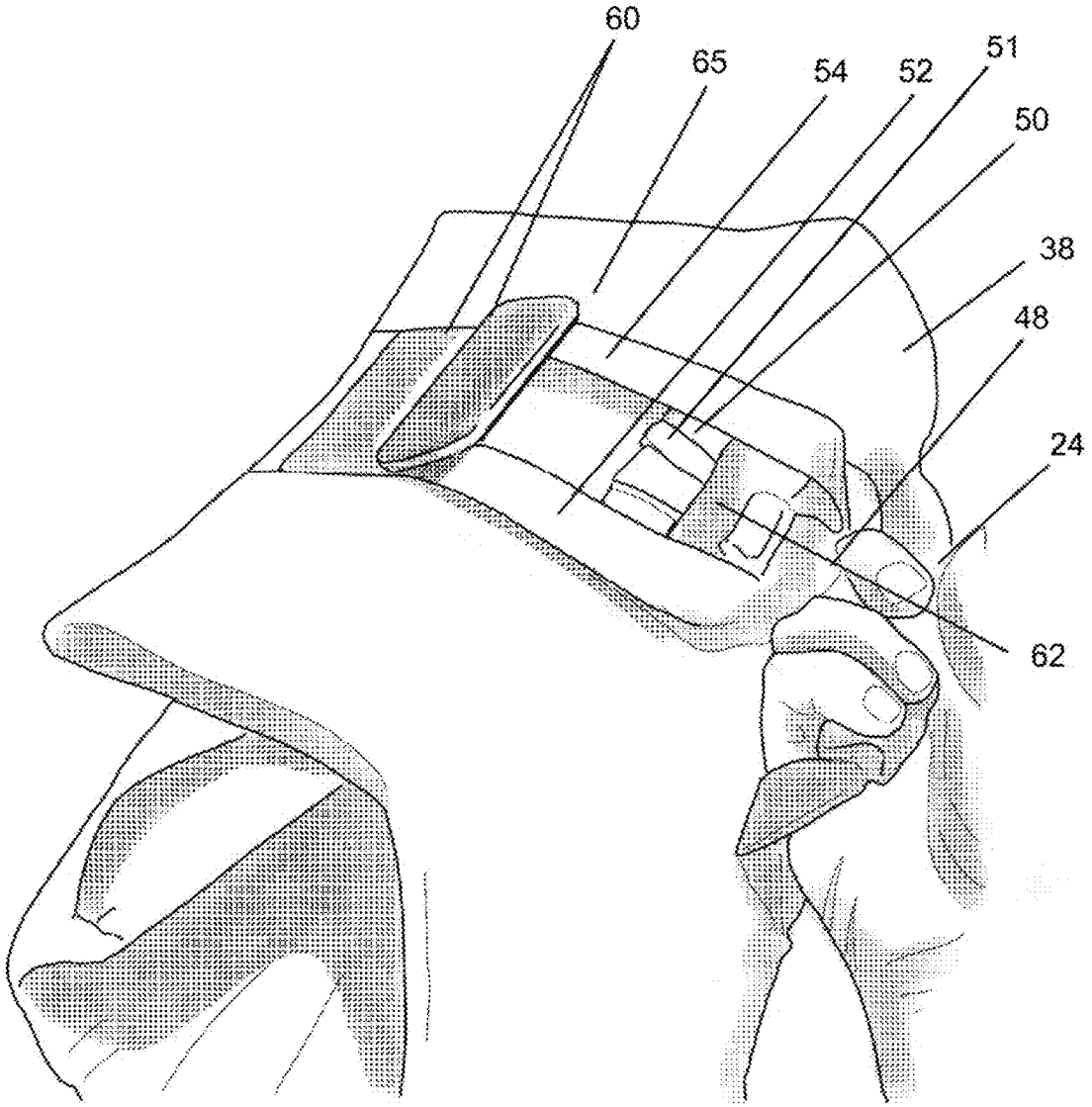
FIG. 12 shows the shield seen in FIG. 11 with the hook and loop fastener of the shield partially decoupled.

FIGS. 11 and 12 show the mechanism by which the shield 38 can be deployed (unrolled) with the same hand that holds the shield, or alternatively using the free hand.

A user's fingers can reach through and past the handle 24 to grip a T-bar 48. The T-bar 48 is connected to a plastic bar 50 with two flexible (e.g. fabric) straps 51, for example. Straps 51 are slidable under a fabric strip 62, which is attached to the carrier. The plastic bar 50 is connected to two flexible (e.g. fabric) straps 52, 54. The two straps 52,54 are connected to another plastic bar 56. The another plastic bar 56 is attached to one of the two parts of the hook and loop fastener 60.

Using the fingers to pull on the T-bar 48 in turn pulls on the plastic bar 50, which causes the decoupling of the hook and loop fastener 60 by pulling on the plastic bar 56 as see in in FIG. 12, permitting the shield 38 to unroll due to the spring strength of unrolling of the rolled resilient panel 16' and the rolled second resilient panel 16". Consequently, the second embodiment can be triggered to deploy with the same hand that is holding the handle 24, leaving the other hand free.

A shield 38 according to the second embodiment is very light; an 18"×36" shield weighs 7 pounds. It has been shown to stop all the handgun rounds typically encountered. Specifically, thirty-four rounds were put into a single 18"×36" panel with no perforations: 357 Magnum (4); 9 mm Luger (8); 0.45 ACP (7); 0.40 S&W (7); 44 Rem. Magnum (8).

Figure 13:
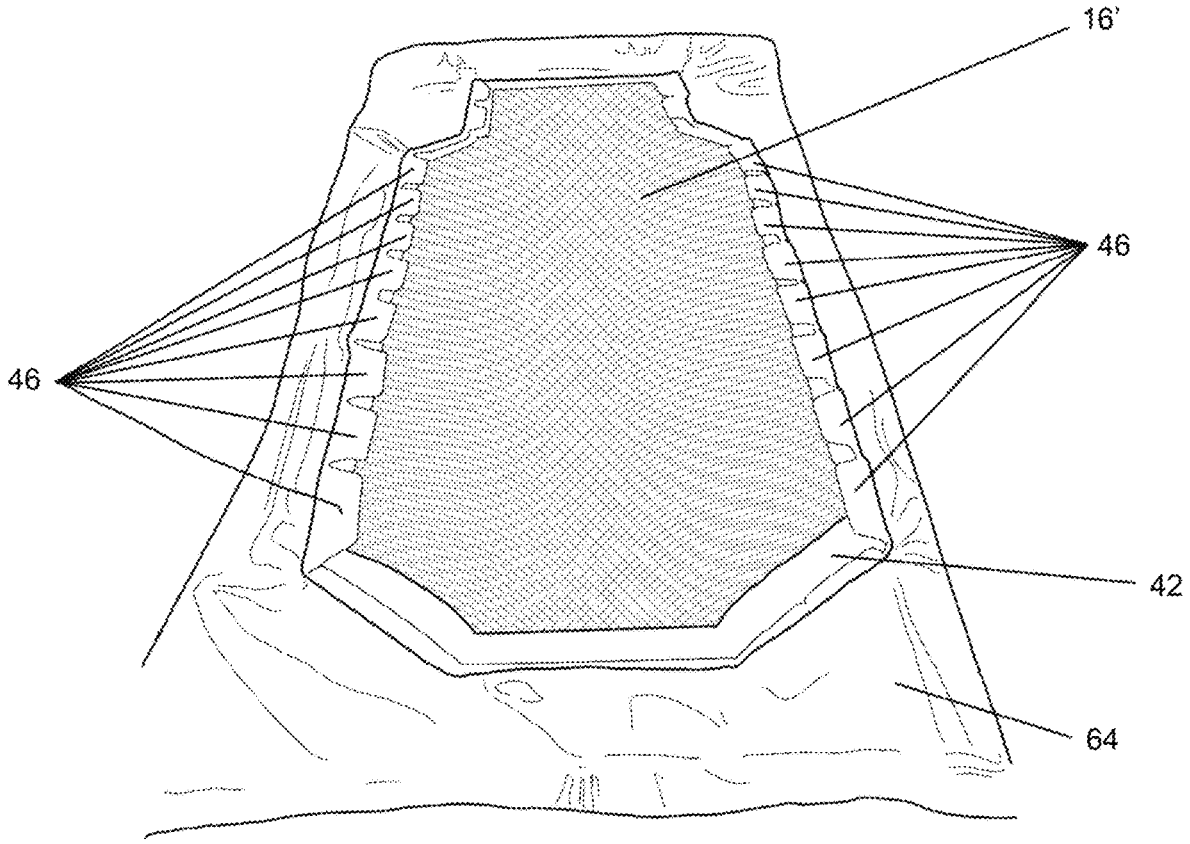
FIG. 13 demonstrates an alternative step in the method of constructing a shield according to the present invention.

Referring to FIG. 13, wrapping the serrated fabric flaps 46 around the resilient panel 16' may be carried out using a temporary clear plastic sealed enclosure 64. The interior of enclosure 64 is evacuated to apply the atmospheric pressure to press the flaps 46 around the side and onto the strike face of the resilient panel 16'. The enclosure 64 is kept in the evacuated stated for a period of time until the flexible ballistic panel 14' conforms to the shape of the resilient panel 16'. The enclosure 64 is then cut open and removed.

Figure 14:
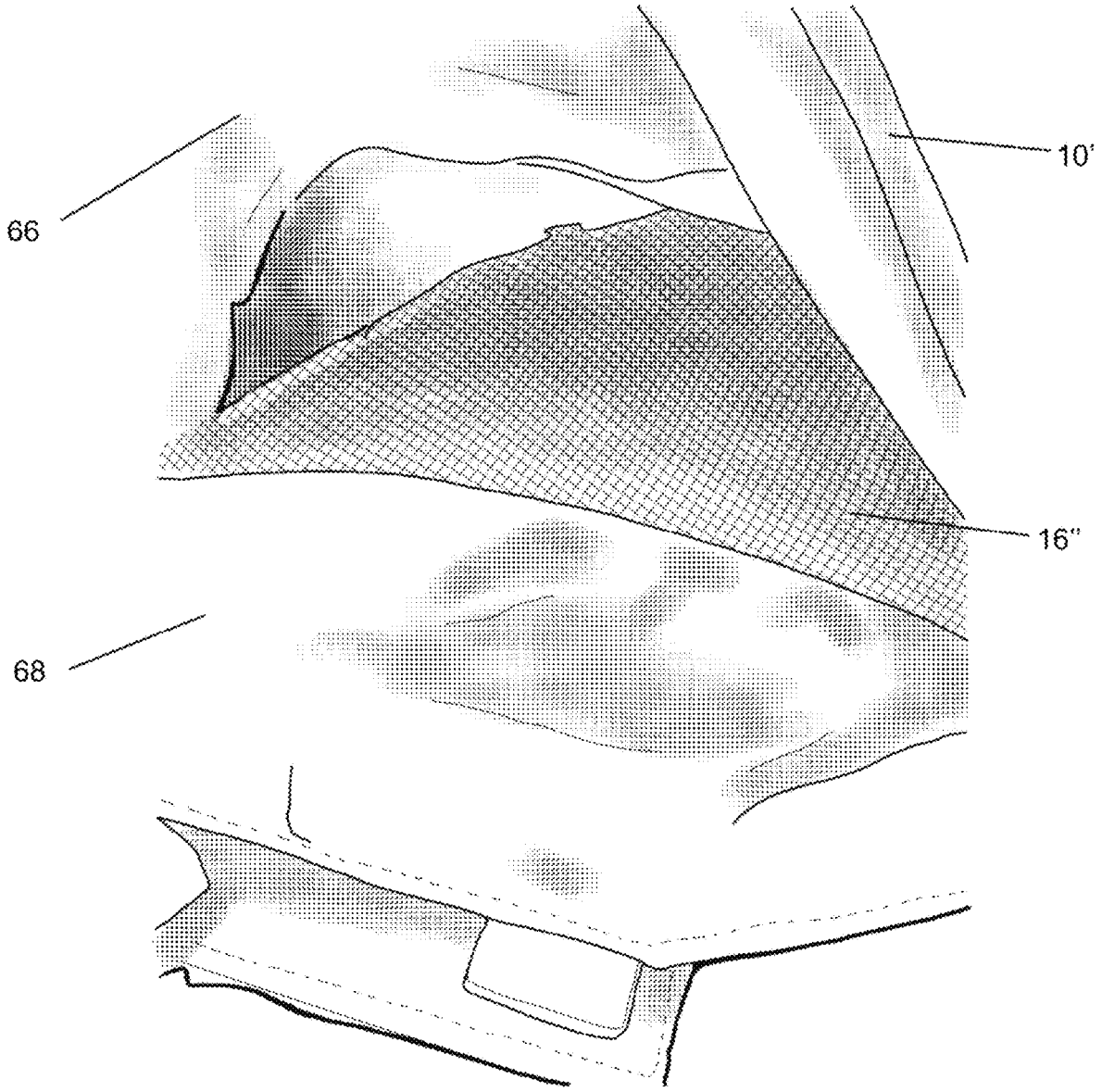
FIG. 14 shows a bottom view of a carrier, viewed from the strike face into the interior of the carrier, for a shield according to the third embodiment of the present invention.
Figure 15:
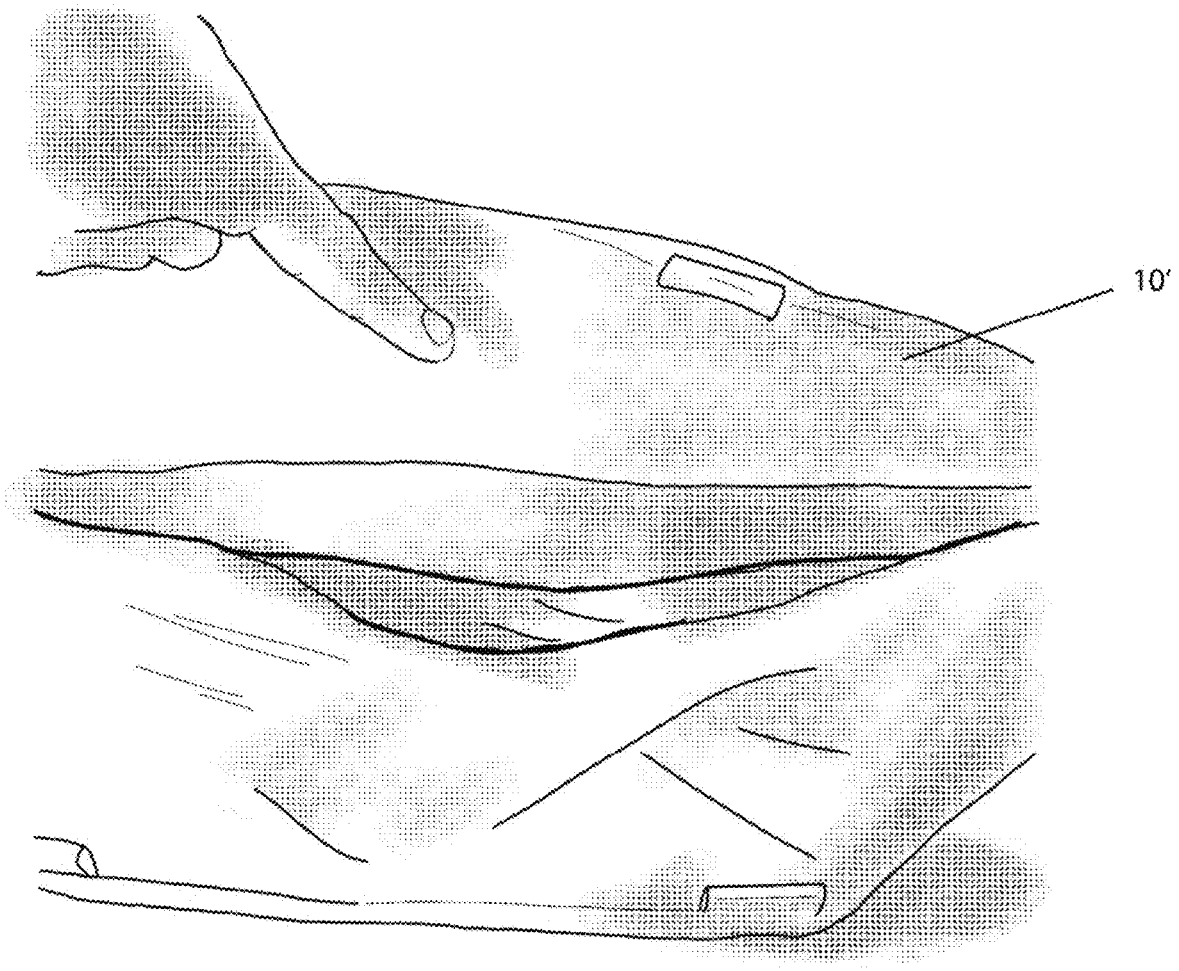
FIG. 15 shows a bottom view of a carrier, viewed from the rear face into the interior of the carrier, for a shield according to the third embodiment of the present invention.

In a shield 65 according to the third embodiment, the carrier 10' no longer includes an elastomeric closure using strap 20 and a bottom flap 18. Referring to FIGS. 14 and 15, the carrier 10' of the third embodiment has a pocket 66 at the bottom of the strike face and a pocket 68 at the bottom of the rear face of the carrier 10'. The strike face pocket 66 cradles the bottom of the sealed inner enclosure 40 and its contents, which better supports the weight of the flexible ballistic panel 14', and better maintains proper alignment with the resilient panel 16' in the inner enclosure 40. The rear face pocket 68 cradles the bottom of the second resilient panel 16", which gives support against stresses pulling against the adhesive lamination between the second resilient body 16" and the interior rear face side of the carrier 10' that adheres the two bodies to one another. The adhesive may alternatively be a spray on adhesive. Having the different components in different pockets allows for an increase in independent movement during rolling and unrolling, while sustaining alignment in the unrolled state.

In the third embodiment, the inner enclosure 40 no longer has a large amount of slack all the way around the resilient panel 16', and the ballistic panel 14'. In this embodiment, cover 40 now has close to the minimum amount of slack needed so that rolling and unrolling is unimpeded.

Figure 16:
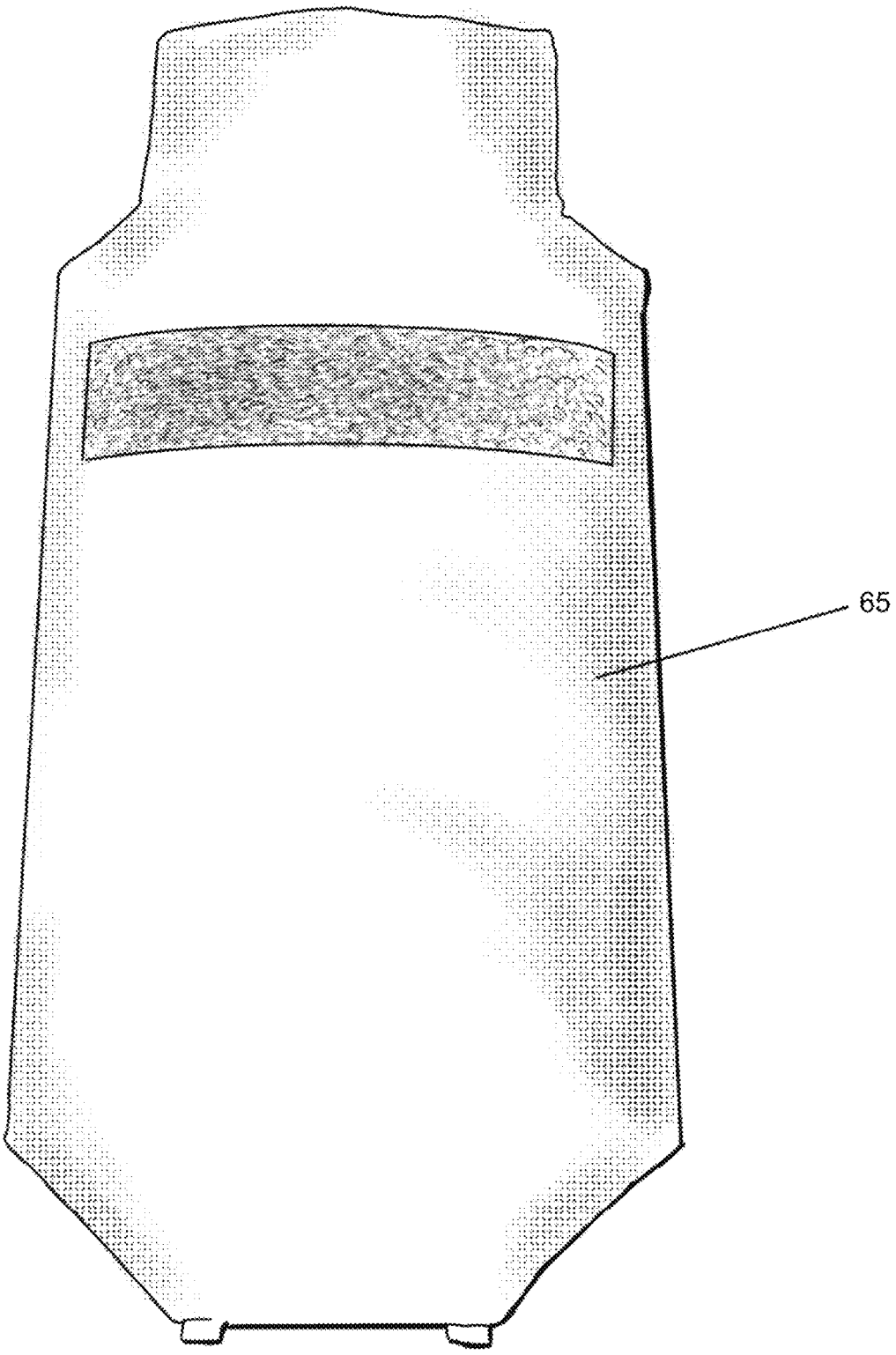
FIG. 16 shows the strike (front) face of the shield according to the third embodiment.
Figure 17:
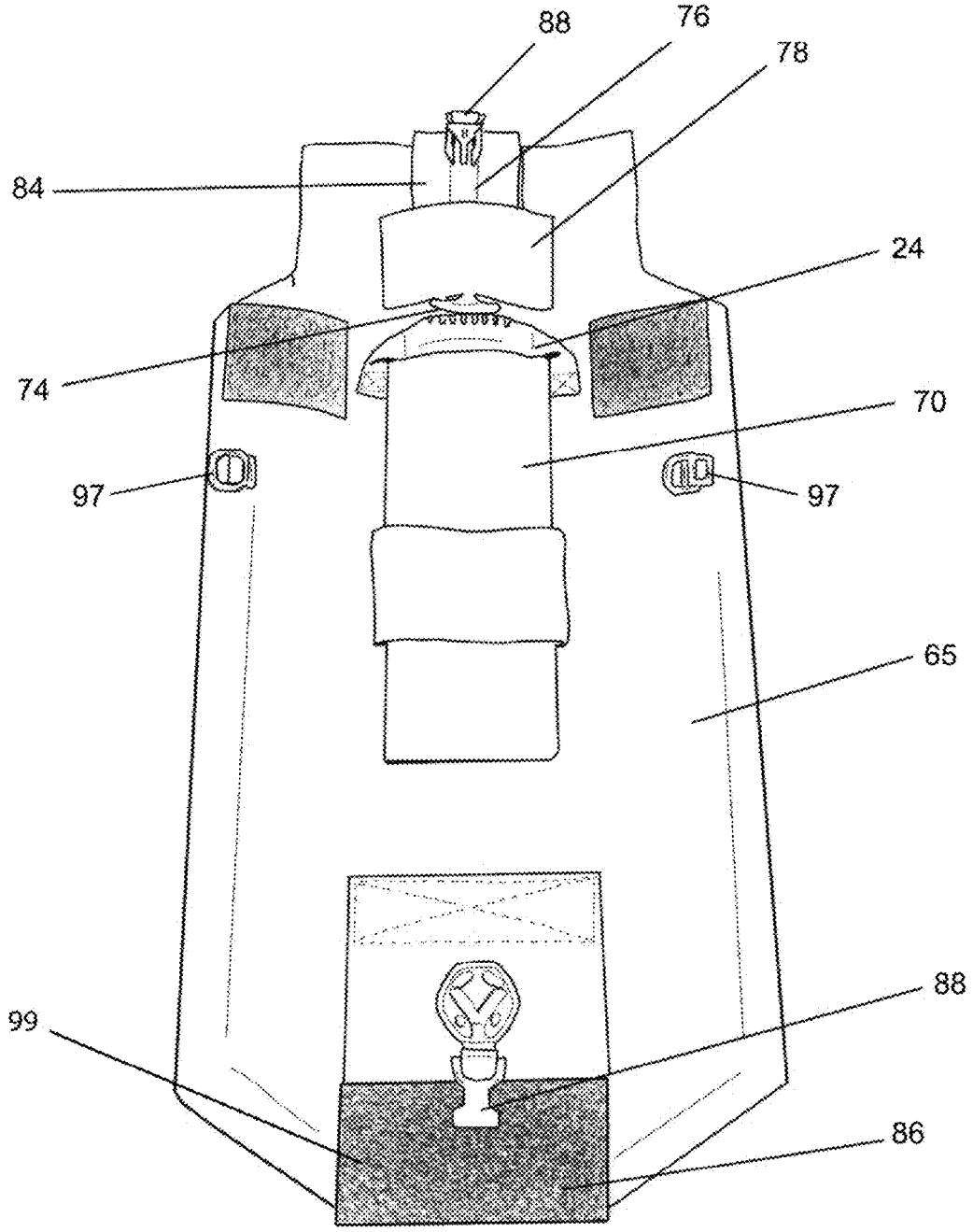
FIG. 17 shows the rear face of the shield according to the third embodiment.
Figure 18:
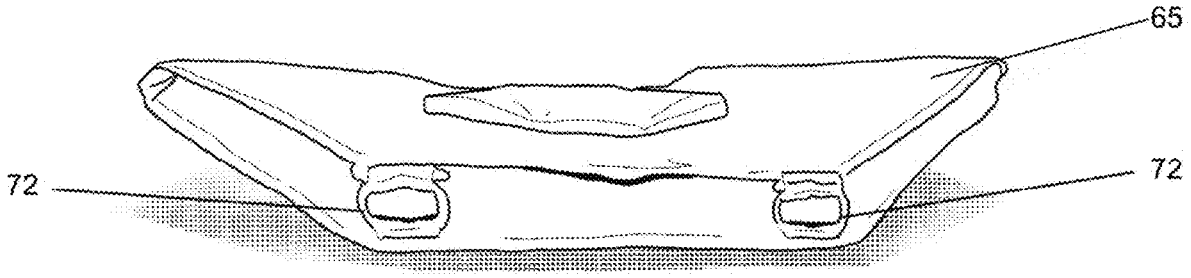
FIG. 18 shows a bottom view of the shield according to the third embodiment.

FIGS. 16 and 17 show respectively the strike face and the rear face of the shield 65 in the deployed state. Foam padding 70 may be placed where the hand and the forearm holding the shield 65 are to be positioned. The "D" rings 97 in FIG. 17 are the attachment points for a sling. FIG. 18 shows that the open bottom of the shield 65 is drawn closed with shock cord loops 72.

FIGS. 19-22 show a different release mechanism that could be used with the second embodiment or the third embodiment. In this mechanism, a T-shaped actuator (handle) 74 is attached to a single fabric strap 76, which passes under a sewn elastic cover 78 so that portions thereof are held down adjacent to the carrier 10, 10' by the sewn elastic fabric cover 78 (see also FIG. 17). The fabric strap 76 is attached to a flap 84, which is attached to flap 99, in turn sewn to the rear face of the shield 65. The attachment between flaps 76 and 99 are with hook and loop fasteners 86, 87.

Figure 19:
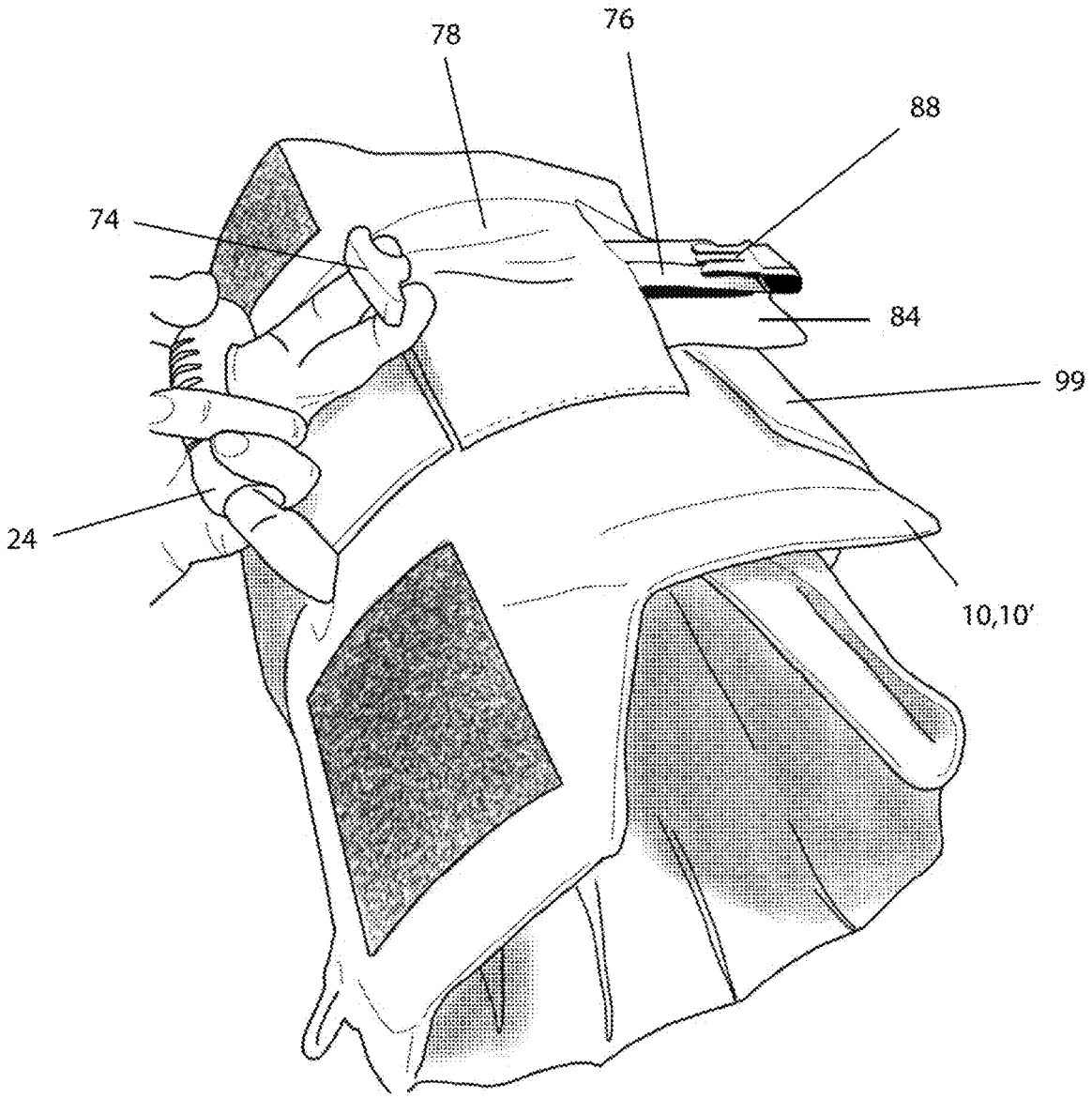
FIG. 19 shows the shield according to the third embodiment in the rolled state, and additionally showing an alternative release mechanism.
Figure 20:
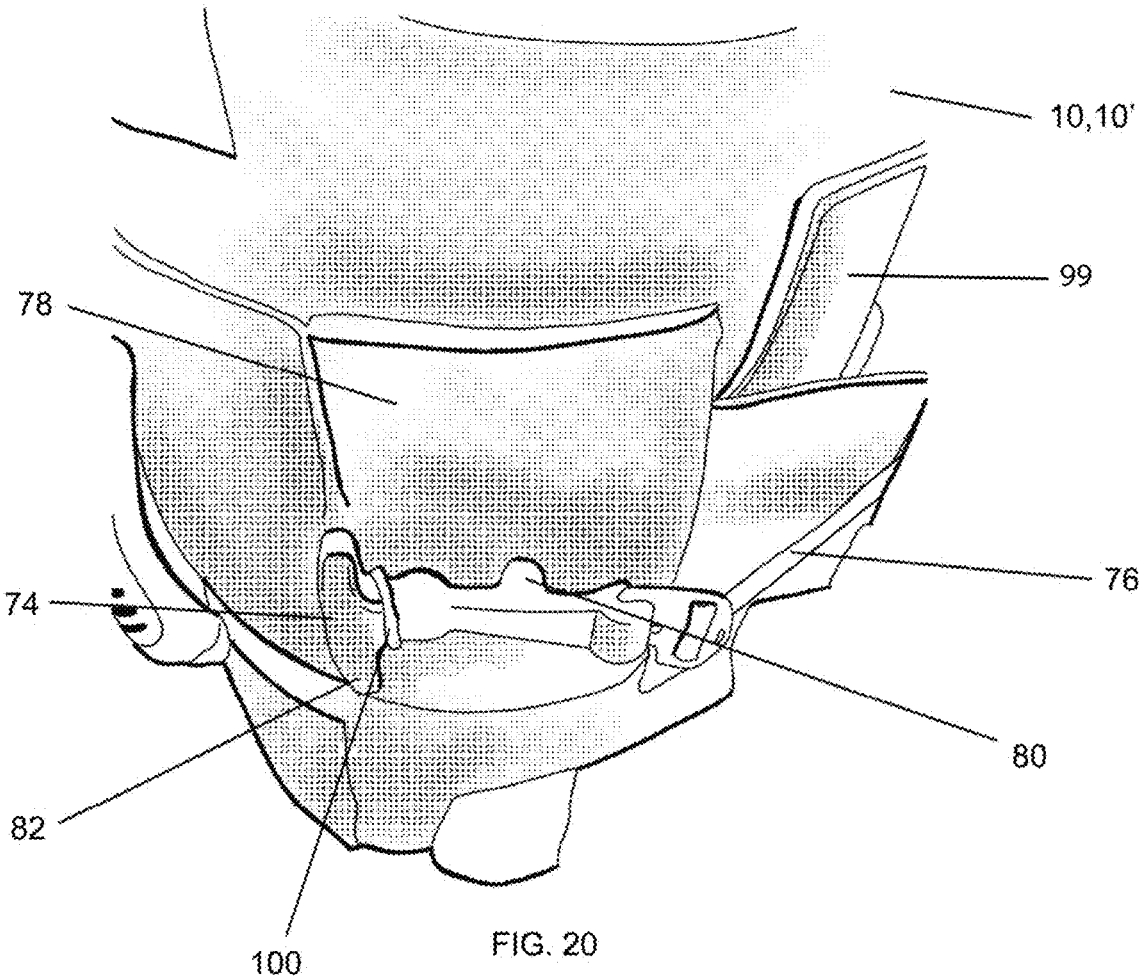
FIG. 20 shows an enlarged view of the release mechanism with its T-shaped actuator in an exposed state.

Referring to FIG. 20, the actuator 74 (shown outside the elastic cover 78 so that its features can be seen) has a nub 80 that by pushing against the carrier 10,10' spaces the actuator 74 slightly off of the carrier 10, 10'. Counteracting this is shock cord 100, sewn to the rear face of the carrier, wrapped tightly around the T-grip 82, holding it close to the carrier surface. These features are designed so that the T-grip section 82 can be easily and reliably accessed by the operator's fingers reaching under and past the T-grip section 82 of the actuator (handle) 74 (FIG. 19).

Figure 21:
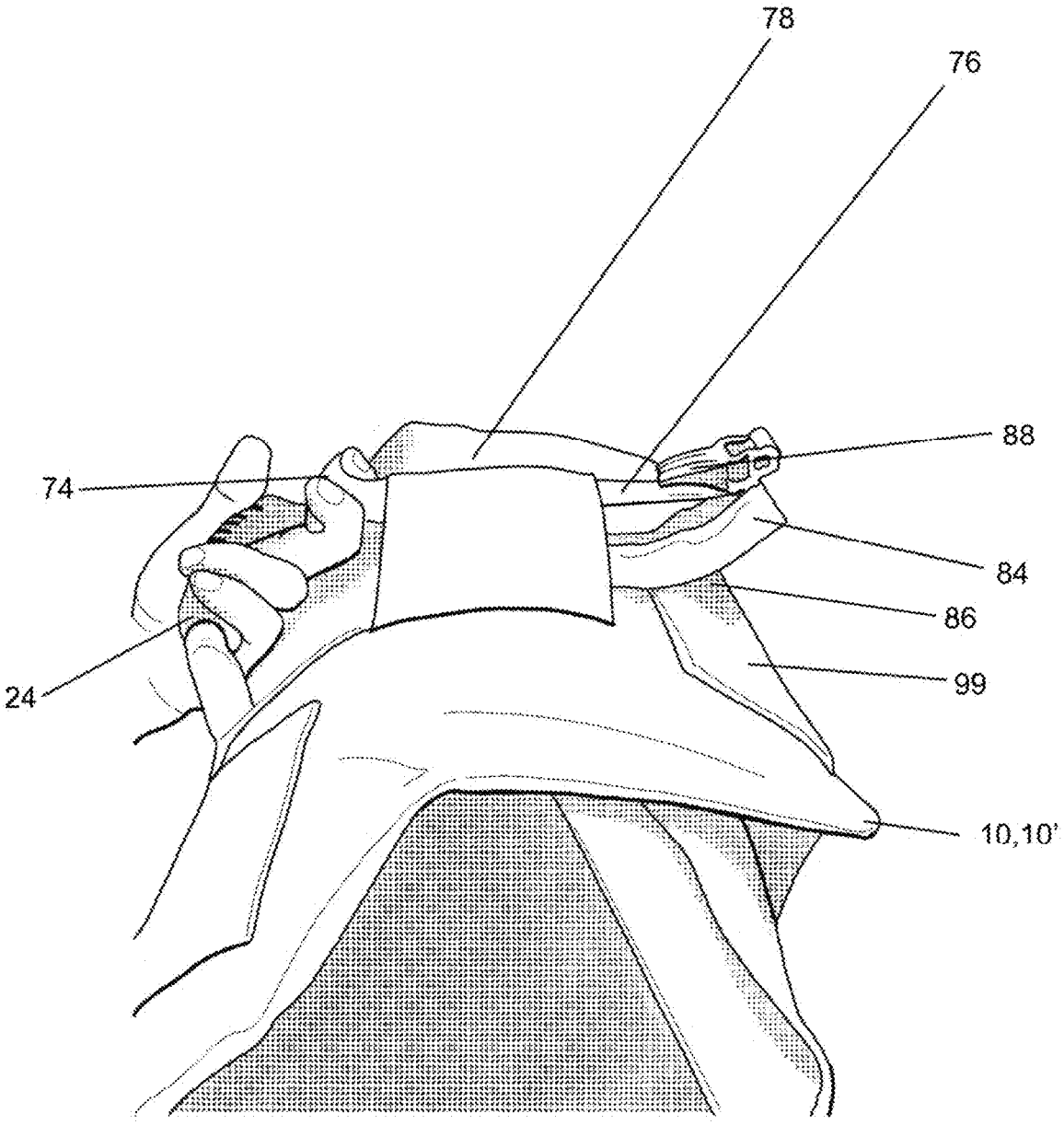
FIG. 21 shows the shield according to the third embodiment in the rolled state while the operator is pulling on the actuator.
Figure 22:
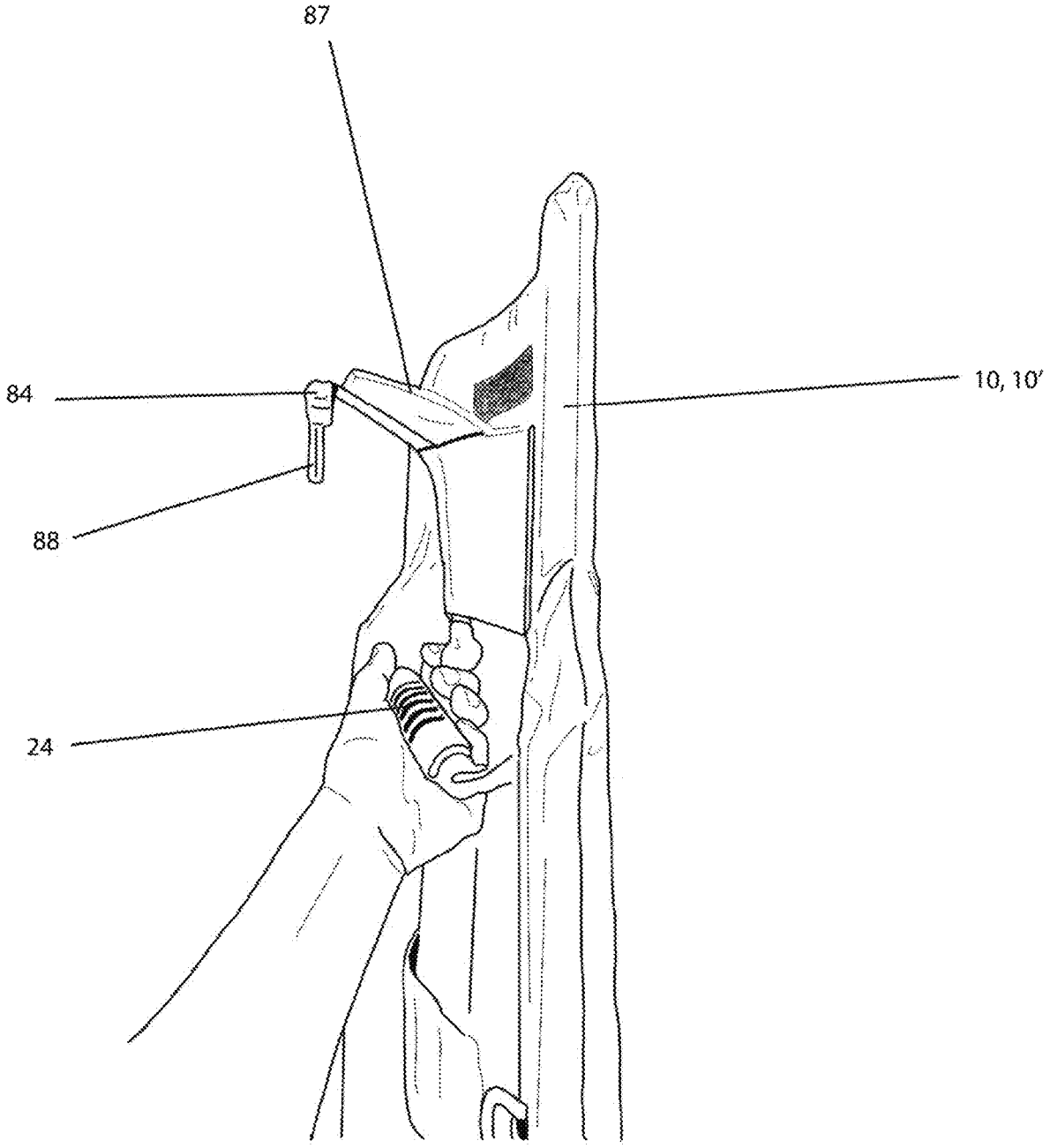
FIG. 22 shows the shield according to the third embodiment in the unrolled (deployed) state following the completion of the release.

Referring to FIG. 21, inside the flap 84 being lifted off of one of the parts 86 of a hook and loop fastener is a stiff plastic rectangular plate (not shown). The plastic plate, while flexible, is stiff enough so that it can cause the separation of the hook and loop surfaces (86 on flap 99 and corresponding, cooperating part 87 under the flap 84) to occur as a unit. Cooperating part 87 is shown in FIG. 22.

To roll up the shield 65, it can be placed with the rear surface against a flat surface, and with one hand on the strike face, the shield 65, previously curved, is pushed flat at its center. While pushing down at the center with one hand, the bottom of the shield is lifted with another hand and rotated 180 degrees so that the top of the strike face touches back of the one hand holding down the center of the shield. The one hand is then used to lift the top of the shield 65 and rotate it 180 degrees so that it overlaps the rotated upper portion of the shield 65 (the extent of overlap may be seen, for example, in FIG. 19). The another hand is extracted while the one hand holds the rotated shield top and bottom portions in place. The another hand positions flap 99 under flap 84, and attaches hook and loop fasteners 86 and 87. This holds the shield 65 its rolled state for storage.

An additional buckle 88 (shown in the unattached state in FIGS. 17, 19, 21, and 22) can be used to ensure that the hook-and-loop fastener 86, 87 remain fastened when the shield is rolled into its stored state to avoid potential accidental deployment (unrolling) during rough handling.

Figure 23:
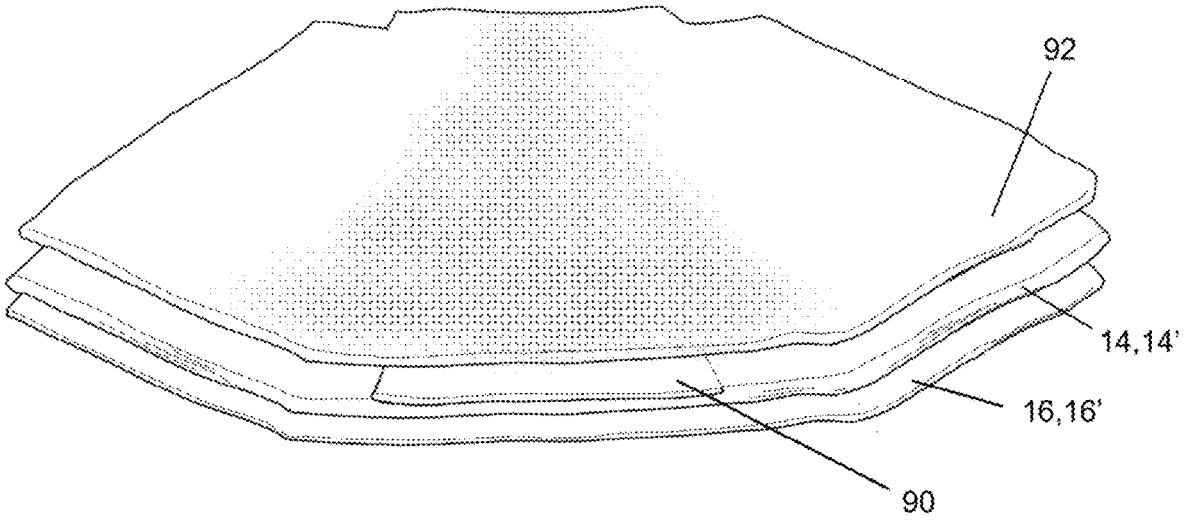
FIG. 23 shows another embodiment of the present invention that includes a rib assembly for enhanced unrolling.

Referring to FIG. 23, to enhance the unrolling/deployment of a shield according to the present invention, a rib assembly 90 may be inserted at the rear of the flexible ballistic panel 14,14', between the flexible ballistic panel 14,14' and the foam layer(s) 92. The foam layer(s) 92 may have the same shape and dimensions as the flexible ballistic panel 14, 14' and resilient panel 16, 16' (which is at the strike face side of the flexible ballistic panel 14, 14'). This assembly is then encapsulated in the inner enclosure 40.

Figure 24:
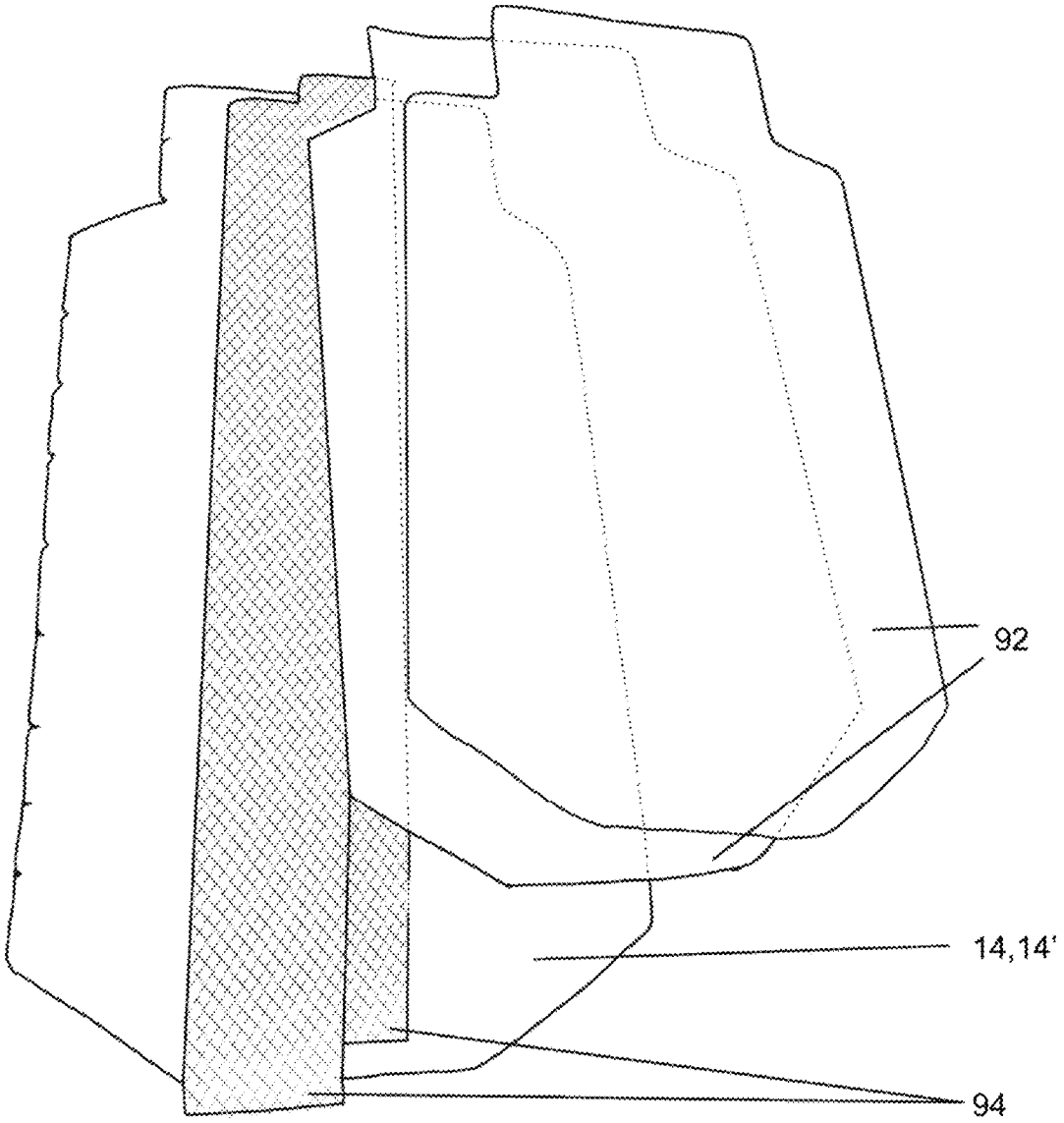
FIG. 24 shows the rib panels of the rib assembly in a disassembled state along with the foam layer(s), and the flexible ballistic panel, in a disassembled state.

Referring to FIG. 24, the rib assembly 90 may be made, for example, of two four-inch-wide elongated rib panels 94. Each rib panel 94 may be made with three sheets of carbon fiber prepreg fabric that are consolidated into a unitary body by autoclaving, for example. The rib panels 94 have the same radius of curvature set in them as the resilient panel 16, 16'. The radii of curvature of the rib panels 94 face the rear face (the same as the resilient panel 16, 16').

Figure 25:
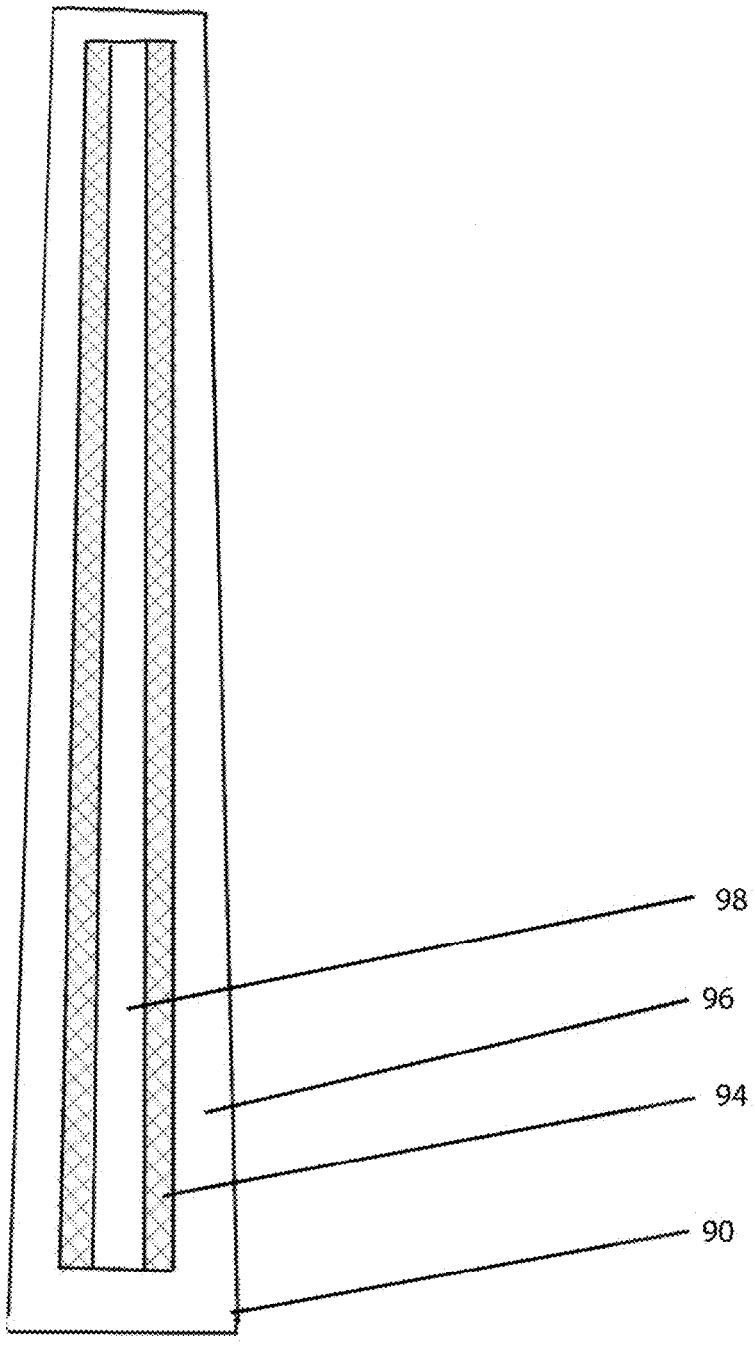
FIG. 25 shows the rib assembly and the flexible ballistic panel in a disassembled state.

Referring to FIG. 25, the elongated rib panels 94 are attached to one another along the edges thereof by adhesive-coated aramid fabric 96. The rib panels 94 are not otherwise attached to one another. A strip of (double-sided) adhesive 98 is placed along the center line of the rear face side of the rib assembly 90. The adhesive strip affixes the rib assembly to the foam layer(s) 92, which resides on the rear face side of the ballistic fabric pack 14, 14'. The adhesively attached foam layer(s) 92 and the rib assembly 90 are not attached to the flexible ballistic panel 14, 14', but are inside the inner enclosure 40, and in turn inside the carrier 10, 10'. It has been found that even without being attached, the mutual alignment of the rib assembly 90, the foam layer(s) 92, and the flexible ballistic panel 14, 14' is maintained.

A shield according to the present invention has the unique ability to act rigidly or semi-rigidly when deployed, which allows the shield to stand up under its own weight, be controllable and responsive through its handle, not collapse when not vertically oriented, and can be used as a drag litter.

A shield according to the present invention has the advantage of a standard "hard" shield, but is uniquely semi-rigid to deform slightly when the shield encounters an obstacle, making the interaction less jarring to the operator.

A shield according to the present invention can also be used as a ballistic barrier to be placed as a blanket over a victim, used as an explosive blast shield, can be placed adjacent to a vehicle's windshield because it readily deforms over the steering wheel to fit over the dash, can be hung over vehicle doors, and can be hung over school doors or door frames.

Multiple shields can be combined through attachment points and hook and loop fasteners so that a group of operators can advance with ballistic protection.

Optionally, a shield according to the present invention can include an add-on accessory viewport. The viewport could take the form of an entirely separate piece that is mounted on post deployment, or as a piece that flips up (potentially by the aid of the resilient panel incorporation) post deployment and locks into place. Such viewports would be made of transparent armor, typically polycarbonate for handgun protection, up to spinel ceramics for rifle protection.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A rollable ballistic shield, comprising:

a flexible ballistic panel, the flexible ballistic panel being comprised of a plurality of sheets of ballistic fabric; and a resilient panel in contact with only one face of the flexible ballistic panel, the resilient panel being a body that is rollable from an unrolled state to a rolled state, and from the rolled state to the unrolled state when permitted to unroll under a spring force, wherein, in the unrolled state, the resilient panel is curved about a first axis, wherein the resilient panel, in its unrolled state, is rollable around an axis transverse to the first axis, and wherein the resilient panel unrolls the flexible ballistic panel from a rolled state to a fully unrolled state when the resilient panel is unrolled from the rolled state to its unrolled state.

2. The rollable ballistic shield of claim 1, wherein the resilient panel is curved about its first axis, and the first axis is its longitudinal axis.

3. The rollable ballistic shield of claim 2, wherein the curved resilient panel has a radius of curvature in the range 4 to 6 inches.

4. The rollable ballistic shield of claim 1, wherein the plurality of sheets of ballistic fabric in the flexible ballistic panel are stitched together.

5. The rollable ballistic shield of claim 4, wherein the plurality of sheets of ballistic fabric comprise sheets of ultra-high molecular weight polyethylene ballistic fabric.

6. The rollable ballistic shield of claim 1, wherein the resilient panel is a unitary body comprised of consolidated carbon fiber prepreg fabrics.

7. The rollable ballistic shield of claim 1, wherein the flexible ballistic panel comprises a plurality of spaced flaps that wrap over edges of the resilient body, giving the edges more firmness against snapback during a near-edge ballistic impact and improving ballistic performance for shots near the edges while spaces between the plurality of spaced flaps allow the shield to be rolled up without the flaps bunching up and restricting movement.

8. The rollable ballistic shield of claim 1, wherein the flexible ballistic panel and the resilient panel are slidable relative to one another to facilitate unrestricted rolling and unrolling.

9. The rollable ballistic shield of claim 1, further comprising an elongated rib assembly having at least one elongated rib located at the flexible ballistic panel's rear face.

10. The rollable ballistic shield of claim 9, wherein the elongated rib assembly has a plurality of elongated ribs connected to one another, each comprising a carbon fiber panel, and wherein the resilient panel and the rib assembly are curved about their longitudinal axes.

11. The rollable ballistic shield of claim 1, wherein the resilient panel is comprised of at least two attached resilient bodies each being made of consolidated carbon fiber prepreg fabric sheets.

12. The rollable ballistic shield of claim 1, further comprising a carrier having a strike face and a rear face opposite the strike face, wherein the flexible ballistic panel and the resilient panel reside in the carrier.

13. The rollable ballistic shield of claim 12, further comprising an inner enclosure, wherein the flexible ballistic panel and the resilient panel are inside of the inner enclosure.

14. The rollable ballistic shield of claim 13, wherein the inner enclosure is water-tight.

15. The rollable ballistic shield of claim 12, further comprising another resilient panel in the carrier located between the flexible ballistic panel and the rear face of the carrier.

16. The rollable ballistic shield of claim 15, wherein the carrier has a first pocket that receives a bottom portion of the another resilient panel, and a second pocket that receives a bottom portion of the resilient panel and a bottom portion of the flexible ballistic panel.

17. The rollable ballistic shield of claim 15, wherein the resilient panel and the another resilient panel are both curved.

18. The rollable ballistic shield of claim 12, wherein the carrier includes an upper section and a lower section, the upper section being narrower than the lower section, wherein shapes of the resilient panel and the flexible ballistic panel correspond to the carrier's shape and are received in the carrier without play to keep the carrier in a taut state.

19. The rollable ballistic shield of claim 18, wherein the carrier has a transition section located between the upper section and the lower section, the transition section is as wide as the upper section along one edge thereof, and as wide as the lower section along an opposite edge thereof.

20. The rollable ballistic shield of claim 18, wherein the upper section is no more than 33% of the carrier's length and the lower section is at least 60% of the carrier's length.

21. The rollable ballistic shield of claim 12, wherein the carrier further comprises a handle and an actuator located close enough to the handle to permit an operator to, with a single hand, hold the shield and reach the actuator while the shield is in the rolled state, wherein the actuator is movable, and wherein moving the actuator releases a fastener that keeps the shield in the rolled state, allowing the shield to rapidly unroll.

22. The rollable ballistic shield of claim 12, wherein the carrier comprises a handle, and further comprising a second resilient panel inside the carrier and glued to the carrier to push the flexible ballistic panel into the first resilient panel, whereby the first resilient panel, the flexible ballistic panel, and the second resilient panel are tightly held together inside the carrier making the shield responsive to the manipulation of the handle.

23. The rollable ballistic shield of claim 4, wherein the plurality of sheets of ballistic fabric comprise sheets of aramid ballistic fabric.

24. A rollable ballistic shield, comprising:

a flexible ballistic panel, the flexible ballistic panel being comprised of a plurality of sheets of ballistic fabric; and a resilient panel, the resilient panel being a body that is rollable but, with a spring force, returns to its unrolled shape when permitted to unroll, wherein the flexible ballistic panel comprises a plurality of spaced flaps that wrap over edges of the resilient body, giving the edges more firmness against snapback during a near-edge ballistic impact and improving ballistic performance for shots near the edges while spaces between the plurality of spaced flaps allow the shield to be rolled up without the flaps bunching up and restricting movement.

25. A rollable ballistic shield, comprising:

a flexible ballistic panel, the flexible ballistic panel being comprised of a plurality of sheets of ballistic fabric; and a resilient panel, the resilient panel being a body that is rollable but, with a spring force, returns to its unrolled shape when permitted to unroll, wherein the flexible ballistic panel and the resilient panel are slidable relative to one another to facilitate unrestricted rolling and unrolling.

26. A rollable ballistic shield, comprising:

a flexible ballistic panel, the flexible ballistic panel being comprised of a plurality of sheets of ballistic fabric;

a resilient panel, the resilient panel being a body that is rollable but, with a spring force, returns to its unrolled shape when permitted to unroll; and an elongated rib assembly having at least one elongated rib located at the flexible ballistic panel's rear face, wherein the elongated rib assembly has a plurality of elongated ribs connected to one another, each comprising a carbon fiber panel, and wherein the resilient panel and the rib assembly are curved about their longitudinal axes.

27. A rollable ballistic shield, comprising:

a flexible ballistic panel, the flexible ballistic panel being comprised of a plurality of sheets of ballistic fabric;

a resilient panel, the resilient panel being a body that is rollable but, with a spring force, returns to its unrolled shape when permitted to unroll;

a carrier having a strike face and a rear face opposite the strike face, wherein the flexible ballistic panel and the resilient panel reside in the carrier; and another resilient panel in the carrier located between the flexible ballistic panel and the rear face of the carrier, wherein the carrier has a first pocket that receives a bottom portion of the another resilient panel, and a second pocket that receives a bottom portion of the resilient panel and a bottom portion of the flexible ballistic panel.

28. A rollable ballistic shield, comprising:

a flexible ballistic panel, the flexible ballistic panel being comprised of a plurality of sheets of ballistic fabric;

a resilient panel, the resilient panel being a body that is rollable but, with a spring force, returns to its unrolled shape when permitted to unroll;

a carrier having a strike face and a rear face opposite the strike face, wherein the flexible ballistic panel and the resilient panel reside in the carrier; and another resilient panel in the carrier located between the flexible ballistic panel and the rear face of the carrier, wherein the resilient panel and the another resilient panel are both curved.

29. A rollable ballistic shield, comprising:

a flexible ballistic panel, the flexible ballistic panel being comprised of a plurality of sheets of ballistic fabric;

a resilient panel, the resilient panel being a body that is rollable but, with a spring force, returns to its unrolled shape when permitted to unroll; and a carrier having a strike face and a rear face opposite the strike face, wherein the flexible ballistic panel and the resilient panel reside in the carrier, wherein the carrier comprises a handle, and further comprising a second resilient panel inside the carrier and glued to the carrier to push the flexible ballistic panel into the first resilient panel, whereby the first resilient panel, the flexible ballistic panel, and the second resilient panel are tightly held together inside the carrier making the shield responsive to the manipulation of the handle.

* * * * *